US005107747A

United States Patent [19]

Saito

[11] Patent Number: 5,107,747

[45] Date of Patent: Apr. 28, 1992

[54] CHANNEL ASSIGNING DEVICE

[75] Inventor: Tsutomu Saito, Iwata, Japan

[73] Assignee: Kawai Musical Inst. Mfg. Co. Ltd., Sizuoka, Japan

[21] Appl. No.: 483,383

[22] Filed: Feb. 22, 1990

[30] Foreign Application Priority Data

Feb. 22, 1989 [JP] Japan ..... 1-42298

[51] Int. Cl.[5] ..... G10H 1/057; G10H 1/06; G10H 1/22

[52] U.S. Cl. ..... 84/655; 84/656; 84/658; 84/659; 84/663; 84/DIG. 2

[58] Field of Search ..... 84/615-633, 84/653-655, 678-711, DIG. 2

[56] References Cited

U.S. PATENT DOCUMENTS 4,269,102 5/1981 Kondo et al. ..... 84/655

4,350,068 9/1982 Suzuki et al. ..... 84/615

4,450,745 5/1984 Nakada et al. ..... 84/622

*Primary Examiner*—Stanley J. Witkowski

[57] ABSTRACT

An electronic musical instrument with a channel assigning device which includes a characteristic information generating unit for generating characteristic information of musical tone envelopes, a sound radiation instructing unit for generating each musical tone selected by a musical tone selecting unit, a processing unit for processing the characteristic information generated by the characteristic information generating unit in response to an elapse of time and an assigned channel determining unit for comparing the results of the processing performed by the processing unit and determining a channel to which the musical tone information should be assigned in response to a sound radiation instruction from the sound radiation instructing unit.

20 Claims, 22 Drawing Sheets

CKT : CIRCUIT
KBD : KEY-BOARD

FIG. 1 FIG. 1(b)

ENVELOPE CHARACTERISTIC DATA

| | | $C_2$ ~ | $C_3$ ~ | $C_4$ ~ | $C_5$ ~ | $C_6$ ~ |
|---|---|---|---|---|---|---|
| NOTAB | SUS=0 | 20H | 20H | 20H | 20H | 20H |
| | SUS=1 | 20H | 20H | 20H | 20H | 20H |
| PIANO | SUS=0 | 74H | 60H | 4CH | 38H | 24H |
| | SUS=1 | FFH | EFH | DFH | CFH | BFH |
| VIRAPHONE | SUS=0 | 68H | 60H | 58H | 50H | 48H |
| | SUS=1 | C2H | B2H | A2H | 92H | 82H |
| ... | ... | ... | ... | ... | ... | ... |
| STRINGS-1 | SUS=0 | 4CH | 4AH | 48H | 46H | 44H |
| | SUS=1 | 94H | 92H | 90H | 8EH | 8CH |
| ... | ... | ... | ... | ... | ... | ... |
| BRASS | SUS=0 | 33H | 32H | 31H | 30H | 30H |
| | SUS=1 | 76H | 74H | 72H | 70H | 70H |
| ... | ... | ... | ... | ... | ... | ... |

FIG.1(c)

HOLDING DATA

| | |
|---|---|
| NOTAB | 1 |
| PIANO | 0 |
| VIBRAPHONE | 0 |
| ... | ... |
| STRINGS-1 | 1 |
| ... | ... |
| BRASS | 1 |
| ... | ... |

FIG.1(a)

TONE NUMBER

| | | $C_2$ ~ | $C_3$ ~ | $C_4$ ~ | $C_5$ ~ | $C_6$ ~ |
|---|---|---|---|---|---|---|
| NOTAB | VELO<40H | 00H | 00H | 00H | 00H | 00H |
| | VELO≧40H | 00H | 00H | 00H | 00H | 00H |
| PIANO | VELO<40H | 01H | 02H | 03H | 04H | 05H |
| | VELO≧40H | 06H | 07H | 08H | 09H | 0AH |
| VIBRAPHONE | VELO<40H | 0BH | 0BH | 0CH | 0DH | 0DH |
| | VELO≧40H | 0EH | 0EH | 0FH | 10H | 10H |
| ... | ... | ... | ... | ... | ... | ... |
| STRINGS-1 | VELO<40H | 1DH | 1DH | 1DH | 1DH | 1DH |
| | VELO≧40H | 1EH | 1EH | 1EH | 1EH | 1EH |
| ... | ... | ... | ... | ... | ... | ... |
| BRASS | VELO<40H | 26H | 26H | 27H | 27H | 27H |
| | VELO≧40H | 28H | 28H | 29H | 29H | 29H |
| ... | ... | ... | ... | ... | ... | ... |

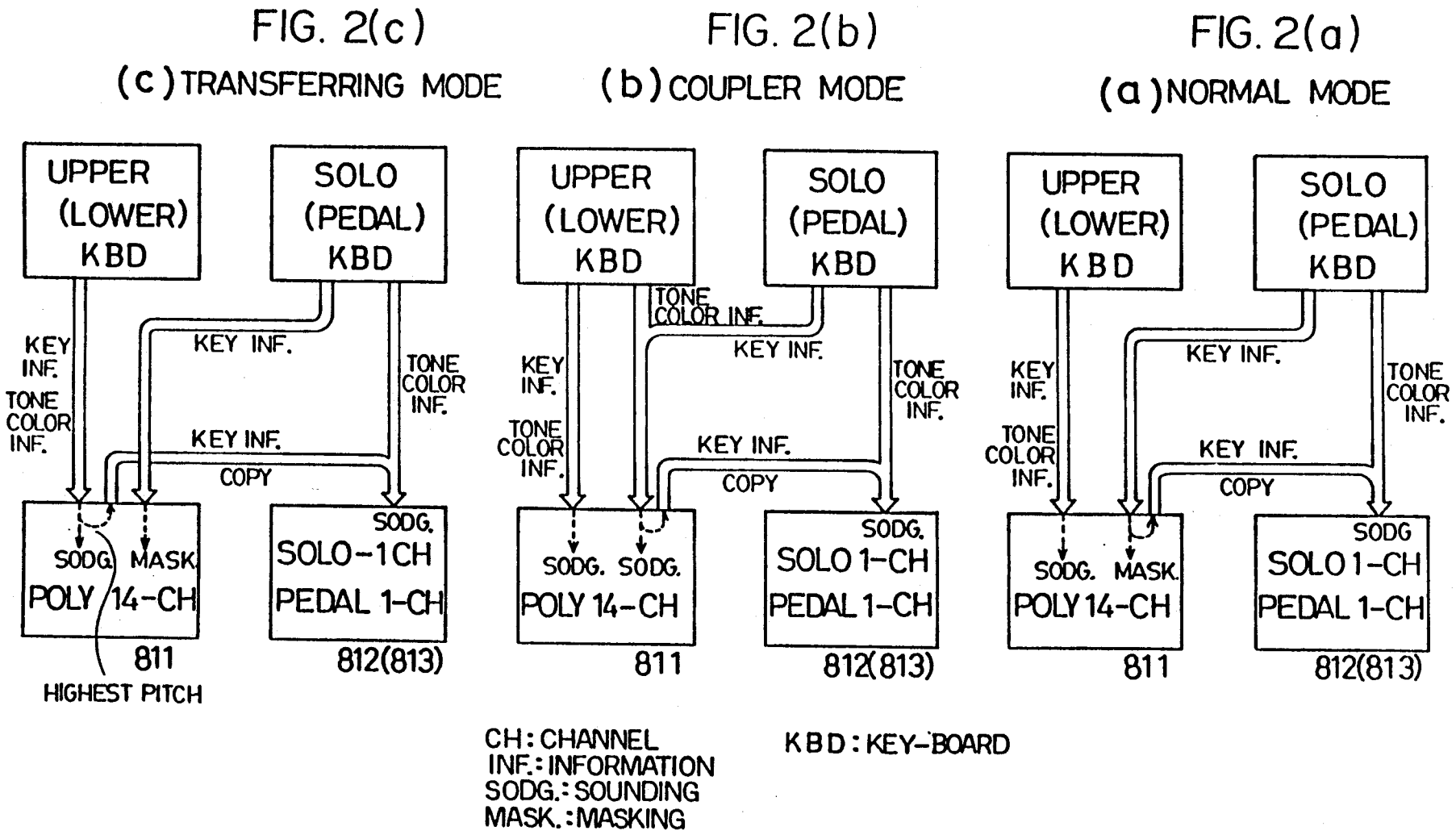
FIG. 2(a)
(a) NORMAL MODE
SOLO (PEDAL) KBD
UPPER (LOWER) KBD
TONE COLOR INF.
KEY INF.
KEY INF.
COPY
SODG SOLO 1-CH PEDAL 1-CH
812(813)
SODG. MASK. POLY 14-CH
811
FIG. 2(b)
(b) COUPLER MODE
SOLO (PEDAL) KBD
UPPER (LOWER) KBD
TONE COLOR INF.
KEY INF.
KEY INF.
COPY
SODG. SOLO 1-CH PEDAL 1-CH
812(813)
SODG. SODG. POLY 14-CH
811
FIG. 2(c)
(c) TRANSFERRING MODE
SOLO (PEDAL) KBD
UPPER (LOWER) KBD
TONE COLOR INF.
KEY INF.
KEY INF.
COPY
SODG. SOLO-1CH PEDAL 1-CH
812(813)
SODG MASK POLY 14-CH
811
HIGHEST PITCH
KBD : KEY-BOARD
CH : CHANNEL
INF. : INFORMATION
SODG. : SOUNDING
MASK. : MASKING ≧64μs
KEY ON/OFF
ENV.
HIGH-SPEED RELEASE

ASSIM. STORING MEM.
KEY CODE
TONE NO.
GROUP
X1
X2
Y1
Y2
Z1
Z2

ASSIM. BUFFER MEM.
KEY CODE
TONE NO.
GROUP
X1
X2
Y1
Y2
Z1
Z2
ENV. : ENVELOPE
ASSIM. : ASSIGNMENT
MEM. : MEMORY

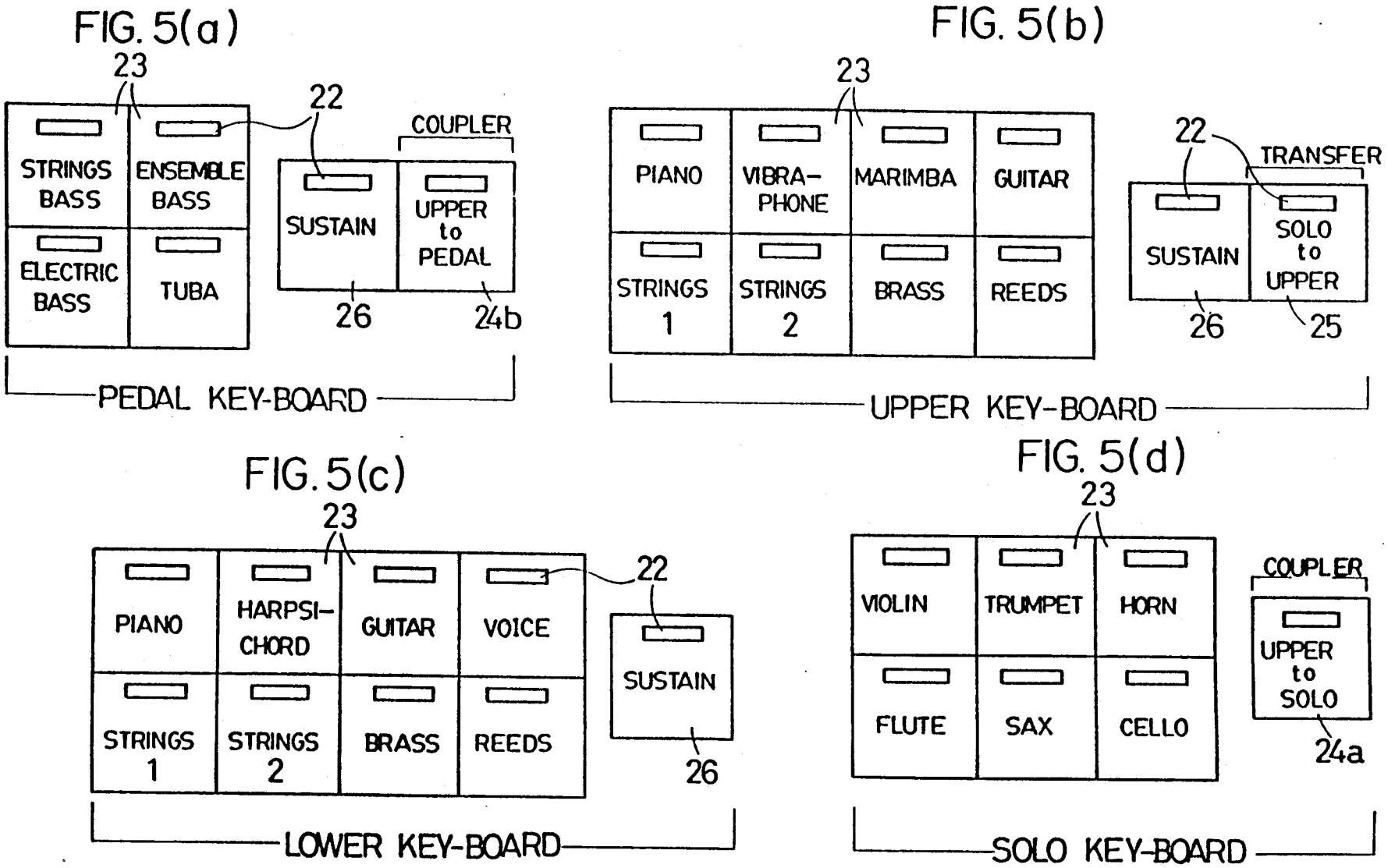
FIG. 5(a)
STRINGS BASS
ELECTRIC BASS
ENSEMBLE BASS
TUBA
23
22
SUSTAIN
26
COUPLER
UPPER to PEDAL
24b
PEDAL KEY-BOARD
FIG. 5(b)
PIANO
VIBRA-PHONE
MARIMBA
GUITAR
STRINGS 1
STRINGS 2
BRASS
REEDS
23
SUSTAIN
26
22
TRANSFER
SOLO to UPPER
25
UPPER KEY-BOARD
FIG. 5(c)
PIANO
HARPSI-CHORD
GUITAR
VOICE
STRINGS 1
STRINGS 2
BRASS
REEDS
23
22
SUSTAIN
26
LOWER KEY-BOARD
FIG. 5(d)
VIOLIN
TRUMPET
HORN
FLUTE
SAX
CELLO
23
COUPLER
UPPER to SOLO
24a
SOLO KEY-BOARD

SOLO KEYBOARD

| TRANSFER SOLO to UPP. | COUPLER UPP. to SOLO | POLY. 14-CH UPPER KEYBOARD TIMBRE | SOLO 1-CH SOLO KEYBOARD TIMBRE |
|---|---|---|---|
| 0 | 0 | – | O |
| 0 | 1 | O | O |
| 1 | 0 | – | – |
| 1 | 1 | O | – |

FIG. 6(a)

UPPER KEYBOARD

| TRANSFER. SOLO to UPP. | COUPLER UPP. to SOLO | COUPLER UPP. to PED. | POLY. 14-CH UPPER KEYBOARD TIMBRE | SOLO 1-CH SOLO KEYBOARD TIMBRE |
|---|---|---|---|---|
| 0 | 0 | 0 | O | – |
| 0 | 0 | 1 | O | – |
| 0 | 1 | 0 | O | – |
| 0 | 1 | 1 | O | – |
| 1 | 0 | 0 | O | O |
| 1 | 0 | 1 | O | O |
| 1 | 1 | 0 | O | O |
| 1 | 1 | 1 | O | O |

FIG.6(b)

LOWER KEYBOARD

| | POLY. 14-CH LOWER KEYBOARD TIMBRE |
|---|---|
| UNCONDITIONAL | O |

FIG. 6(c)

PEDAL KEYBOARD

| COUPLER UPP. to PED. | POLY. 14-CH UPPER KEYBOARD TIMBRE | SOLO 1-CH SOLO KEYBOARD TIMBRE |
|---|---|---|
| 0 | – | O |
| 1 | O | O |

FIG. 6(d)

O : SOUNDED
– : UNSOUDED

FIG. 7(a)

REGISTER PORTION 61

- SCANNING ADDRESS
- EVENT BIT
- EVENT KEY CODE
- EVENT GROUP
- EVENT VELOCITY
- SEARCH CH (n)
- MIN. ENV. CHAR.
- MIN. ENV. CHAR. CH
- SEARCH GROUP
- HIGH KEY DATA
- HIGH KEY CH
- SUBTRACTING CH (n)

FIG. 7(b)

KEY SWITCH MEMORY (OLD) 62

| | 7 | 6 | 5 | 4 | 3 | 2 | 1 | 0 | |
|---|---|---|---|---|---|---|---|---|---|
| 00 | | $F_2$ | $E_2$ | $D^{\#}_2$ | $D_2$ | $C^{\#}_2$ | $C_2$ | | UPPER |
| 01 | | $B_2$ | $A^{\#}_2$ | $A_2$ | $G^{\#}_2$ | $G_2$ | $F^{\#}_2$ | | |
| 02 | | $F_3$ | $E_3$ | $D^{\#}_3$ | $D_3$ | $C^{\#}_3$ | $C_3$ | | |
| ⋮ | | ⋮ | ⋮ | ⋮ | ⋮ | ⋮ | ⋮ | | |
| 08 | | $F_6$ | $E_6$ | $D^{\#}_6$ | $D_6$ | $C^{\#}_6$ | $C_6$ | | |
| 09 | $C_7$ | $B_6$ | $A^{\#}_6$ | $A_6$ | $G^{\#}_6$ | $G_6$ | $F^{\#}_6$ | | |
| 0A | | $F_2$ | $E_2$ | $D^{\#}_2$ | $D_2$ | $C^{\#}_2$ | $C_2$ | | LOWER |
| 0B | | $B_2$ | $A^{\#}_2$ | $A_2$ | $G^{\#}_2$ | $G_2$ | $F^{\#}_2$ | | |
| 0C | | $F_3$ | $E_3$ | $D^{\#}_3$ | $D_3$ | $C^{\#}_3$ | $C_3$ | | |
| ⋮ | | ⋮ | ⋮ | ⋮ | ⋮ | ⋮ | ⋮ | | |
| 12 | | $F_6$ | $E_6$ | $D^{\#}_6$ | $D_6$ | $C^{\#}_6$ | $C_6$ | | |
| 13 | $C_7$ | $B_6$ | $A^{\#}_6$ | $A_6$ | $G^{\#}_6$ | $G_6$ | $F^{\#}_6$ | | |
| 14 | | $F_2$ | $E_2$ | $D^{\#}_2$ | $D_2$ | $C^{\#}_2$ | $C_2$ | | PEDAL |
| 15 | | $B_2$ | $A^{\#}_2$ | $A_2$ | $G^{\#}_2$ | $G_2$ | $F^{\#}_2$ | | |
| 16 | | $F_3$ | $E_3$ | $D^{\#}_3$ | $D_3$ | $C^{\#}_3$ | $C_3$ | | |
| 17 | $C_4$ | $B_3$ | $A^{\#}_3$ | $A_3$ | $G^{\#}_3$ | $G_3$ | $F^{\#}_3$ | | |
| 18 | | $F_3$ | $E_3$ | $D^{\#}_3$ | $D_3$ | $C^{\#}_3$ | $C_3$ | | SOLO |
| 19 | | $B_3$ | $A^{\#}_3$ | $A_3$ | $G^{\#}_3$ | $G_3$ | $F^{\#}_3$ | | |
| ⋮ | | ⋮ | ⋮ | ⋮ | ⋮ | ⋮ | ⋮ | | |
| 1E | | $F_6$ | $E_6$ | $D^{\#}_6$ | $D_6$ | $C^{\#}_6$ | $C_6$ | | |
| 1F | $C_7$ | $B_6$ | $A^{\#}_6$ | $A_6$ | $G^{\#}_6$ | $G_6$ | $F^{\#}_6$ | | |

FIG. 7(c)

PANEL SWITCH MEMORY (OLD)

| | 7 | 6 | 5 | 4 | 3 | 2 | 1 | 0 (63) | |
|---|---|---|---|---|---|---|---|---|---|
| 0 | | | | | TUBA | ELEC BASS | ENS BASS | STRINGS BASS | PEDAL |
| 1 | | | | UPPER to PEDAL | | | | PED SUS | |
| 2 | REEDS | BRASS | STRINGS 2 | STRINGS 1 | GUITAR | MARIMBA | VIB | PIANO | UPPER |
| 3 | | | | SOLO to UPPER | | | | UPP SUS | |
| 4 | | | CELLO | SAX | FLUTE | HORN | TRUMPET | VIOLIN | SOLO |
| 5 | | | | UPPER to SOLO | | | | | |
| 6 | REEDS | BRASS | STRINGS 2 | STRINGS 1 | VOICE | GUITAR | HARP | PIANO | LOWER |
| 7 | | | | | | | | LOW SUS | |

FIG. 7(d) PANEL DISPLAY MEMORY

| | 7 | 6 | 5 | 4 | 3 | 2 | 1 | 0 (64) | |
|---|---|---|---|---|---|---|---|---|---|
| 0 | | | | | TUBA | ELEC BASS | ENS BASS | STRINGS BASS | PEDAL |
| 1 | | | | UPPER to PEDAL | | | | PED SUS | |
| 2 | REEDS | BRASS | STRINGS 2 | STRINGS 1 | GUITAR | MARIMBA | VIB | PIANO | UPPER |
| 3 | | | | SOLO to UPPER | | | | UPP SUS | |
| 4 | | | CELLO | SAX | FLUTE | HORN | TRUMPET | VIOLIN | SOLO |
| 5 | | | | UPPER to SOLO | | | | | |
| 6 | REEDS | BRASS | STRINGS 2 | STRINGS 1 | VOICE | GUITAR | HARP | PIANO | LOWER |
| 7 | | | | | | | | LOW SUS | |

ASSIGNMENT STORING MEMORY

GROUP: DISCRIMINATION OF SOLO; UPPER; LOWER; PEDAL

FIG. 9

ASSIGNMENT BUFFER MEMORY

802

| | 7 | 6 | 5 | 4 | 3 | 2 | 1 | 0 | |
|---|---|---|---|---|---|---|---|---|---|
| 00 | ON/OFF | KEY CODE | | | | | | | CH0 |
| 01 | — | SUS | VELOCITY | | | | | | |
| 02 | GROUP | TONE NUMBER | | | | | | | |
| 03 | — | | | | | | | | |
| 04 | ON/OFF | KEY CODE | | | | | | | CH1 |
| 05 | — | SUS | VELOCITY | | | | | | |
| 06 | GROUP | TONE NUMBER | | | | | | | |
| 07 | — | | | | | | | | |
| 08 | ⋮ | | | | | | | | |
| ⋮ | | | | | | | | | |
| 38 | ON/OFF | KEY CODE | | | | | | | CH14 |
| 39 | — | SUS | VELOCITY | | | | | | |
| 3A | GROUP | TONE NUMBER | | | | | | | |
| 3B | — | | | | | | | | |
| 3C | ON/OFF | KEY CODE | | | | | | | CH15 |
| 3D | — | SUS | VELOCITY | | | | | | |
| 3E | GROUP | TONE NUMBER | | | | | | | |
| 3F | — | | | | | | | | |

GROUP : DISCRIMINATION OF
SOLO ; UPPER ; LOWER ; PEDAL

FIG. 10 (a) ORGAN TYPE
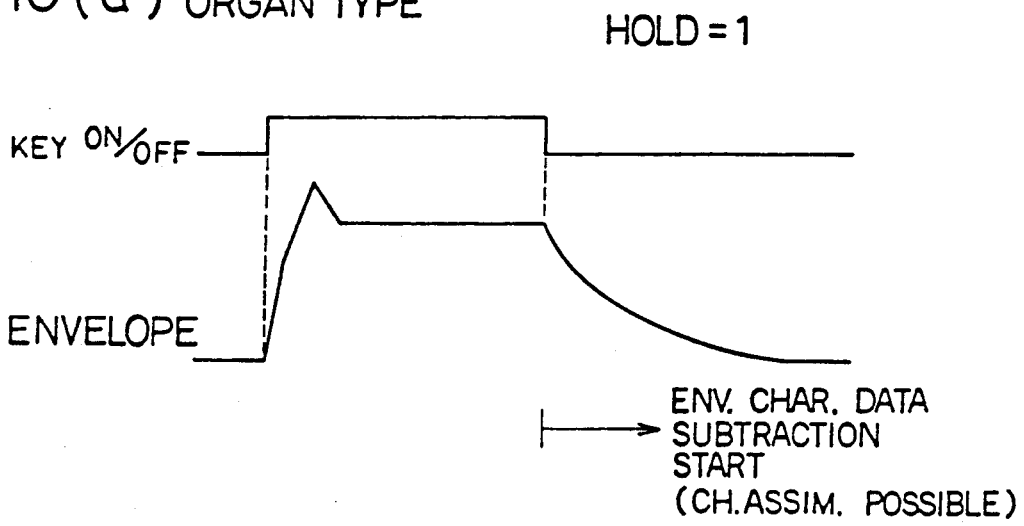
FIG. 10 (b) PERCUS. TYPE
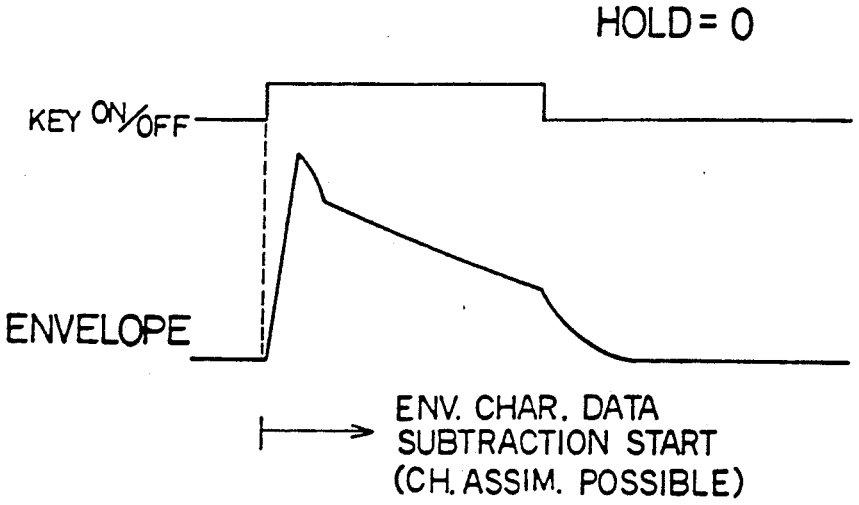
CHAR. : CHARACTERISTIC

SELC.: SELECTOR
SYN.: SYNTHESIS

CHANNEL ASSIGNING DEVICE

BACKGROUND OF THE INVENTION

1. Field of The Invention

This invention generally relates to a channel assigning device for use in an electronic musical instrument, and more particularly, to a channel assigning device by which a most appropriate channel assigning processing can be performed.

2. Description of the Related Art

As a conventional channel assigning device for use in an electronic musical instrument, there is known a device employing a channel pointer which assigns musical tone information to a channel by serially searching channels subsequent to the channel indicated by the channel pointer, to determine whether or not a channel is in the KEY OFF state, i.e., is turned off, when an operation of sounding musical tones is to be carried out. Further, this conventional channel assigning device has been improved to provide a device which stores the order in which keys are turned on and off for every channel, in place of the above-mentioned channel pointer, and assigns musical tone information to a channel on the basis of the thus stored order.

Recently, however, an electronic musical instrument which can generate and sound various musical tones having different envelopes by using only one keyboard has been developed, wherein some of the various envelopes begin decaying even while a key is being pressed and some do not decay until the pressed key is turned off.

Therefore, where musical tone information is assigned to channels on the basis of the order in which keys are turned on or off, as in the conventional musical instrument, the musical tone information on a musical tone having a smallest envelope cannot be preferentially supplied to a channel, and further, the musical instrument generating such a musical tone cannot be assigned a channel. Thus, the conventional devices cannot assign musical tone information to a channel which is most appropriate for the sounding of each musical tone.

The present invention is intended to eliminate the above described defect of the conventional device, and accordingly, an object of the present invention is to provide a channel assigning device for use in an electronic musical instrument and which can assign musical tone information to a channel which is most appropriate for the contents of the envelopes.

Further, in a conventional channel assignment system, when a keyboard is composed of a plurality of keyboard components such as an upper-keyboard, lower-keyboard, solo-keyboard, and pedal-keyboard, key scanning processing, key assigning processing, and channel assignment processing, are performed for each of the keyboard portions. This, however required regulation of the various processes, such as a mutual use of the system for performing the key scanning processing and the key assigning processing among the keyboards, which necessitates a determination of priorities of the keyboards, and therefore, the key scanning processing and the key assigning processing are very complex in the conventional channel assignment system.

Furthermore, in a MIDI (Musical Information Digital Interface) system, for example, when musical tone information is supplied from an external keyboard or the like, the system encounters similar problems, and thus another kind of key assigning processing is required for processing only MIDI musical tone information and a special stack must be dedicated to such key assigning processing. Note, the MIDI is a specification of a communications scheme for digital music devices, and accordingly, the term "MIDI musical tone information" indicates musical tone information generated in accordance with the MIDI specification.

The present invention is also intended to eliminate these drawbacks of the conventional channel assigning system.

Therefore, another object of the present invention is to provide a channel assigning device for use in an electronic musical instrument, by which a most appropriate channel assignment can be obtained by effecting a simple key scanning and assigning processing and by using circuits having a simple structure.

Furthermore, in the conventional channel assigning system, when musical tone information is assigned to all channels and another key is pressed, the earliest musical tone information, determined on the basis of the order in which keys are pressed or turned off, among the musical tone information already assigned to channels at that time is released at high speed, thereby forcibly terminating the sounding of the musical tones and assigning new musical information to the channel to which the thus released musical instrument had been assigned.

When the envelope level is instantly lowered to "0" by such a high speed release, the sounds are generated as noise. This is prevented by delaying the release of the earliest musical tone information to an extent such that noise is not produced. Therefore, during the high speed release, the assignment of new musical tone information to a channel must be deferred, and this is very disadvantageous and places a heavy burden on the system in which the key assigner is composed of microcomputers or the like.

As a means of resolving this problem, it has been proposed that, even during the high speed release, new musical information be assigned to the channel in question, whereby the above described problem of deferring the assignment of new musical tone information is solved, and further, the assignment of musical tone information to channels can be effected at a high speed. Nevertheless, this leads to another problem in that, after the high speed release, the pitch and timbre of a musical tone is changed, and accordingly the quality of the musical tone is also changed.

The present invention is also intended to eliminate these defects of the conventional channel assigning system.

Therefore, still another object of the present invention is to provide a channel assigning device for use in an electronic musical instrument and which can immediately assign musical tone information corresponding to the musical tone, the sounding of which is newly issued, to a channel, and the content of the musical tone information assigned to this channel by that time is not changed until the sounding of the corresponding musical tone is terminated even when musical tone information is assigned to all channels, to thereby obtain the most appropriate channel assignment.

SUMMARY OF THE INVENTION

To attain the above objects, and in accordance with the present invention, there is provided a channel assigning device in which characteristic information indicating the characteristics of different envelopes is serially generated in relation to selected musical tones, instructions for the sounding of which have been received, and the processing thereof corresponding to the elapsed time, and as a result of this processing, a channel to which a musical tone if assigned is determined.

Namely, the envelope characteristic information is classified into a plurality of categories, for example, from a category in which the envelope is most easily decayed to another category in which decay of the envelope is hardest. With a lapse of time, the value indicated by this characteristic information is lowered and musical tone information corresponding to the musical tone, for which new instructions for the sounding thereof have been received, is assigned to a channel of a category indicated by the lowest value among all of the channels. Therefore, regardless of the kind of envelope, musical tone information can be assigned to a channel corresponding to the musical tone having an envelope which is most easily decayed. Note, it is obvious from the above description that other operations such as addition, multiplication, division, and an operation expressed by another logical expression may be effected instead of the subtraction.

In accordance with the present invention, there is also provided a channel assigning device in which a plurality of sound radiating means are collectively searched to detect the presence of the musical tone for which a sounding instruction has been received, and then a channel to which musical tone information is assigned is determined on the basis of the results of the detection, and in which musical tone information from sound radiation instructing means corresponding to another channel assigning means can be assigned to any one of a plurality of channel assigning means provided at each sound radiation instructing means.

Accordingly, processing such as key scanning can be collectively performed on the plurality of sound radiation instructing means, and further, by using only one channel assigning means, musical tone information from a sound radiation instructing means not corresponding to the channel assigning means can be assigned to a channel, and thus processing such as searching and channel assigning can be collectively performed on keys, etc.. Furthermore, as a part of the function of the channel assigning means, only musical tone information from the corresponding sound radiation instructing means may be assigned to a channel, and thus the most appropriate channel assignment can be realized by performing a simple processing and using circuits having a simple structure.

Furthermore, there is provided a channel assigning means in which two channel assigning means are provided; one of which assigns musical tone information corresponding to sound radiating instructions to a channel, and to the other thereof, the contents of this channel assignment are copied, and subsequently, the musical tone is sounded in accordance with the content of the copied information. Therefore, the channel assignment in accordance with a sound radiating instruction can be immediately performed even when a musical tone corresponding to a channel to which the musical tone information corresponding to the sound radiating instruction is assigned is being sounded, and further, when the musical tone corresponding to a channel from which the assignment information is copied is being sounded, the copying of the contents of the channel assignment is delayed until the sounding operation is completed.

Therefore, even where musical tone information is assigned to all of the channels and the musical tones corresponding to all of the channels are being sounded, the content of the new channel assignment can be written into the first of the channel assigning means without the need for a standby period, and on the other hand, the copying of the contents of new channel assignment is delayed until the sounding of the musical tone corresponding to the channel to which the corresponding musical tone information is assigned is terminated, and thereafter, the content of the new channel assignment can be copied to the second channel assigning means. This solves the problem of changes in the pitch and timbre of the musical tone while the musical tone is being sounded, since the most appropriate channel assignment can be realized.

BRIEF DESCRIPTION OF THE DRAWING

Other features, objects and advantages of the present invention will become apparent from the following description of a preferred embodiment with reference to the drawings, in which like reference characters designate like or corresponding parts throughout several views, and in which:

FIG. 1(*a*) is a diagram illustrating tone number data, FIG. 1(*b*) illustrating envelope characteristic data, and FIG. 1(*c*) illustrating holding data;

FIGS. 2(*a*), (*b*) and (*c*) are diagrams illustrating the contents of the musical tone information form keyboards 11–14 to be assigned to the channels of the assignment storing memory 801 wherein FIG. 2(*a*) illustrates normal mode, FIG. 2(*b*) illustrates coupler mode and FIG. 2(*c*) illustrates transferring mode;

FIGS. 5(*a*), (*b*), (*c*), and (*d*) are is a diagrams showing a panel tablet 21, FIG. 5(*a*) illustrates a pedal keyboard, FIG. 5(*b*) illustrates an upper keyboard, FIG. 5(*c*) illustrates a lower keyboard, and FIG. 5(*d*) illustrates a solo keyboard;

FIGS. 6 (*a*)–(*d*) diagrams illustrating the corresponding relationship between the keyboards 11–14 and the channel areas of the assignment storing memory 801 in the channel assignment FIG. 6(*a*) illustrates a solo keyboard, FIG. 6(*b*) illustrate an upper keyboard, FIG. 6(*c*) illustrates a lower keyboard, and FIG. 6(*d*) illustrates a pedal keyboard;

FIG. 7(*a*) is a diagram showing the contents of a register portion 61, FIG. 7(*b*) is a diagram showing the contents of a key switch memory 62, FIG. 7(*c*) is a diagram showing the contents of a panel switch memory 63, FIG. 7(*d*) is a diagram showing the contents of and a panel displaying memory 64;

FIG. 9 is a diagram showing the contents of an assignment butter memory 802;

FIGS. 10(*a*) and (*b*) are diagrams showing the corresponding relationship between kinds of envelopes and holding data wherein FIG. 10(*a*) illustrates organ type data and FIG. 10(*b*) illustrates percussion type data;

DESCRIPTION OF THE PREFERRED EMBODIMENT

Hereinafter, a preferred embodiment of the present invention will be described with reference to the accompanying drawings.

1. OUTLINE OF ENTIRE CONSTRUCTION OF CIRCUIT

Figure 4:
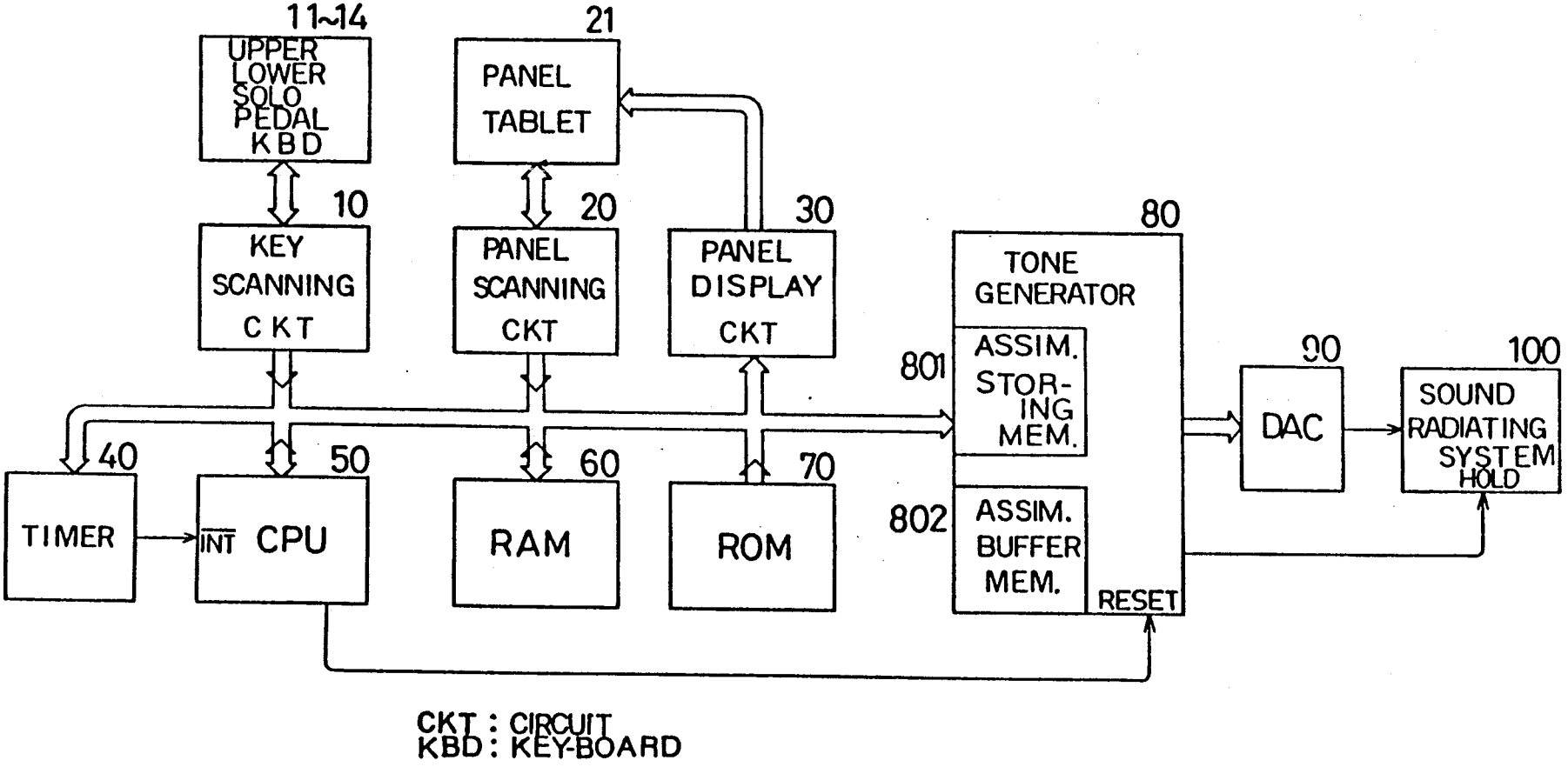
FIG. 4 is a schematic bloc diagram showing the entire construction of the electronic musical instrument embodying the present invention.

FIG. 4 is a schematic block diagram showing the entire construction of the preferred embodiment of the present invention. As shown in the figure, the keyboard comprises an upper keyboard 11, a lower keyboard 12, a solo keyboard 13, and a pedal keyboard 14. Each key of these keyboards 11,12,13 and 14 is scanned by a key scanning circuit 10, to determine whether each of the keys is turned on or off, and data representing the results of the scan is preset in a key switch memory 62 (FIG. 7A) provided in a random access memory (RAM) 60. This key scanning circuit 10 also detects velocity data corresponding to the speed or strength of a KEY ON operation, i.e., the speed or strength of pressing a key. Further, the RAM 60 is used to save the content of a program counter at a stack pointer.

Furthermore, as will be described later, a panel tablet 21 is provided with a large number of switches for selecting tone colors and musical effects and so on, and each key of this panel tablet 21 is scanned by a panel scanning circuit 20 to verify whether each of the keys thereof is turned on or off. Data representing the results of this scanning is preset in a panel switch memory 63 (FIG. 7(*c*)) provided in the RAM 60. The data stored in the panel switch memory 63 is transferred to a panel display memory 64 (FIG. 7(*d*)) by a central processing unit (CPU) 50. Further, the data stored in the panel displaying memory 64 is sent to a panel display circuit 30 by the CPU 50, and then light emitting diodes (LEDs) thereof corresponding respectively to the switches of the panel tablet 21 are turned on or off.

In accordance with the results of the scanning indicated by the data stored in the key switch memory 62 and the panel displaying memory 64, various data required to sound musical tones or musical sounds through each channel is set in an assignment storing memory 801 of a tone generator 80. The data set in this assignment storing memory 801 is transferred to an assignment storing buffer memory 802, whereby musical tone signals corresponding to this data are generated. Subsequently, the musical tone signals are sent to a digital-to-analogue (DA) controller 90 and a sound generating system 100, to sound the musical tones.

On the other hand, an interrupt signal is output from a timer 40 composed of a programable counter to the CPU 50 at constant intervals, and then the subtracting processing of envelope characteristic data stored in the assignment storing memory 801 is performed. Further, a read only memory (ROM) 70 are stored a large amount of tone number data, envelope characteristic data, holding data and so forth, which correspond to each tone color, each compass and the need to sustain effects, and programs used in the CPU 50 for performing various processes.

2. PANEL TABLET 21

FIGS. 5 (*a*)–(*d*) is a schematic diagram showing the arrangement of the switches of the panel tablet 21. As shown in this figure, the panel tablet 21 is composed of tone selecting switches 23, coupler switches 24*a* and 24*b*, a transfer switch 25, and sustain switches 26, which are divided into four groups of keys provided respectively for the upper keyboard 11, the lower keyboard 12, the solo keyboard 13 and the pedal keyboard 14, and are used to select a tone color or timbre and a sustain effect for each of the keyboards 11–14. Note, the sustain effect usually cannot be applied to the solo keyboard 13, but according to this invention, it may be applied thereto.

The "UPPER to SOLO" coupler switch 24*a*, the "UPPER to PEDAL" coupler switch 24*b*, and the "SOLO to UPPER" transferring switch 25 and in the solo, pedal are upper keyboards, respectively.

The coupler switches 24*a* and 24*b* are used for sounding musical tones having the timbre indicated by pressing a key of the upper keyboard 11 (hereunder sometimes referred to as an upper keyboard timbre), as well as musical tones having the timbre indicated by a pressed key of the solo or pedal keyboards 13 and 14. In this case, the pitch of the musical tone having the upper keyboard timbre is that of the musical tone indicated by the pressed key of the solo or pedal keyboards 13 and 14.

In contrast, the transfer switch 25 is used for sounding musical tones having the timbre (hereunder sometimes referred to as a solo keyboard timbre) indicated by pressing a key of the solo keyboard 13, as well as musical tones having the upper keyboard timbre indicated by a pressed key of the upper keyboard 11. As in the case of the coupler switches 24*a* and 24*b*, the pitch of the musical tone having the solo keyboard timbre is that of the musical tone indicated by the pressed key of the upper keyboard 11. Note, when a plurality of keys of the upper keyboard 11 are pressed in this transfer mode, the pitch of a musical tone having the tone color indicated by the solo keyboard 13 to be sounded is the highest of the pitches indicated by the pressed keys of the upper keyboard 11 in this embodiment, but may be the lowest of the pitches indicated by the pressed keys of the upper keyboard 11, or the pitch indicated by the key thereof pressed first or last.

Further, an LED 22 is built in to each of these keys 23, 24*a*, 24*b*, 25 and 25 . . . , and the panel displaying circuit 30 performs the ON-OFF control of these LEDs to thereby indicate the on or off state of each of the switches.

3. COUPLED AND TRANSFER MODES

FIGS. 2 (*a*)–(*c*) and 6 (*a*) are diagrams illustrating the contents of the functions of the musical instrument in the coupled and transfer modes indicated by the coupler switches 24*a* and 24*b* and the transfer switch 25.

In the coupled mode, musical tones having an upper keyboard timbre are sounded by using a polyphonic 14-channel area 811 when a key of the solo keyboard 13 or the pedal keyboard 14 is made on (i.e., when a key of the solo keyboard 13 or the pedal keyboard 14 is pressed down) as shown in FIGS. 2 (*b*), 6 (*a*) and 6 (*d*).

In contrast, in the transfer mode, musical tones having a solo keyboard timbre are sounded by using a solo 1-channel area 812 when a key of the upper keyboard 11 is turned on (i.e., when a key of the upper keyboard 11 is pressed down) as shown in FIGS. 2 (*c*) and 6 (*b*). Further, in this transfer mode, the solo 1-channel area 812 is used by the upper keyboard 11 so that musical tones cannot be sounded when a key of the solo keyboard 13 is turned on.

Further, in a normal mode in which the instrument is released from the coupled and transfer modes, as shown in FIGS. 2 (*a*) and 6 (*a*)-(*d*), musical tones having a solo keyboard timbre are sounded by also using a solo 1-channel area 812 when a key of the solo keyboard 13 is made on. On the other hand, musical tones having a timbre indicated by pressing a key of the pedal keyboard 14 (hereunder sometimes referred to as a pedal keyboard timbre) are sounded by using pedal 1-channel are 813 when a key of the pedal keyboard 14 is made on. Moreover, musical tones having an upper keyboard timbre are sounded by using the polyphonic 14-channel area 811 when a key of the upper keyboard 11 is made on. Accordingly, musical tones each having a plurality of timbres can not be sounded when a key of one of the keyboards 11-14 is pressed down.

In any of the coupled, transfer and normal modes, key information from the solo keyboard 13 and the pedal keyboard 14 is always held in the polyphonic 14-channel area 811. Further, this key information is copied to the solo 1-channel area 812 and the pedal 1-channel area 813, whereby the musical tones having a solo keyboard timbre and those having a pedal keyboard timbre are sounded. Note, in the transfer and normal modes, musical tone information from the solo keyboard 13 and the pedal keyboard 14 held in the 14 polyphonic channel area 811 is masked and the corresponding musical tones are not sounded.

Furthermore, in the coupled mode, among areas belonging to the polyphonic 14-channel area 811, areas other than those used by the solo keyboard 13 and the pedal keyboard 14 are used when a key of the upper keyboard 11 is made on, so that the corresponding musical tones are sounded. Further, when a key of the lower keyboard 12 is made on, musical tones are usually sounded by using one of the areas belonging to the polyphonic 14-channel area 811.

4. RAM 60

FIGS. 7 (*a*), 7 (*b*), 7 (*c*) and 7 (*d*) are diagrams showing the contents of data stored in the RAM 60, which comprises a register portion 61, a key switch memory 61, a panel switch memory 63, a panel display memory 64. Further, the register portion 61 comprises registers for storing scanning address data, event bit data, event key code data, event group data, event velocity data, searching channel (n) data, minimum envelope characteristic data, minimum envelope characteristic channel data, searching group data, high key data, high key channel data, and subtracting channel (n) data. Note, "(n)" denotes a channel area No. indicated by the register in question.

The scanning address data indicates column addresses of the keys of the keyboards 11-14 and the switches of the panel tablet 21, which are arranged in a matrix, to be sequentially scanned. Further, columns of data, obtained by the scanning and indicating the on or off status of each of the keys and switches, are stored in the register in the same way as data is stored in the key switch memory 62 and the panel switch memory 63, as shown in FIGS. 7 (*b*) and 7 (*c*). Further, as shown in these figures, one column of such data is represented by using 8 bits. Note, no keys and switches, which are to be scanned, correspond to bits represented by a blank in FIGS. 7 (*b*) and 7 (*c*). Further, the keys of each of the keyboards 11-14 and the switches of the panel tablet 21 are arranged in an $8\times8$ matrix corresponding to the data matrix stored in the key switch memory 62 and the panel switch memory 63.

Therefore, as seen from FIG. 7 (*b*), the keys of the upper, lower, pedal and solo keyboards 11-14 are serially and continuously scanned, i.e., are collectively scanned, and thus the key scanning processing can be easily and simply performed.

Next, the event bit data indicates a change in the state of each of the keys of the keyboards 11-14 and the switches of the panel tablet 21 from on to off (or from off to on) by making the voltage level of a signal indicating the event bit data high at the time of a change.

Further, the event key code data represents key codes of keys of the keyboards 11-14 to which the event bit is applied, and the event group data indicates to which of the keyboards 11-14 the event key code belongs. Therefore, the event group data comprises upper, lower, pedal and solo group components corresponding respectively to the upper, lower, pedal and solo keyboards 11-14.

Furthermore, the event velocity data represents the speed or strength at which the key is made on or off, and is usually determined on the basis of the difference in time of the turning on of two switches provided at each key or on the basis of data from a pressure sensor.

A search channel (n) register is used for searching for a newly assigned channel, a key-off channel, and a channel to which the musical tone information is copied.

The minimum envelope characteristic data register is used for searching for the minimum envelope characteristic data. This envelope characteristic data will be described with reference to FIGS. 1 (*a*)-(*c*).

The channel number is set in the minimum envelope characteristic data register and the search group data indicates the upper, lower or pedal solo group when searching for a channel.

Further, the high key data register is used for searching for a key corresponding to the highest pitch key among keys which are simultaneously turned on or pressed down.

Also, the channel area number related to data indicating the key corresponding to the highest pitch (hereunder referred to as the high key data) is stored in the high key channel (n) register.

Furthermore, the subtracting channel (n) data indicates a channel area number in which the subtraction of the envelope characteristic data is performed after an input of the interrupt signal from the timer 40.

5. ASSIGNMENT STORING MEMORY 801 AND ASSIGNMENT BUFFER MEMORY 802

Figure 8:
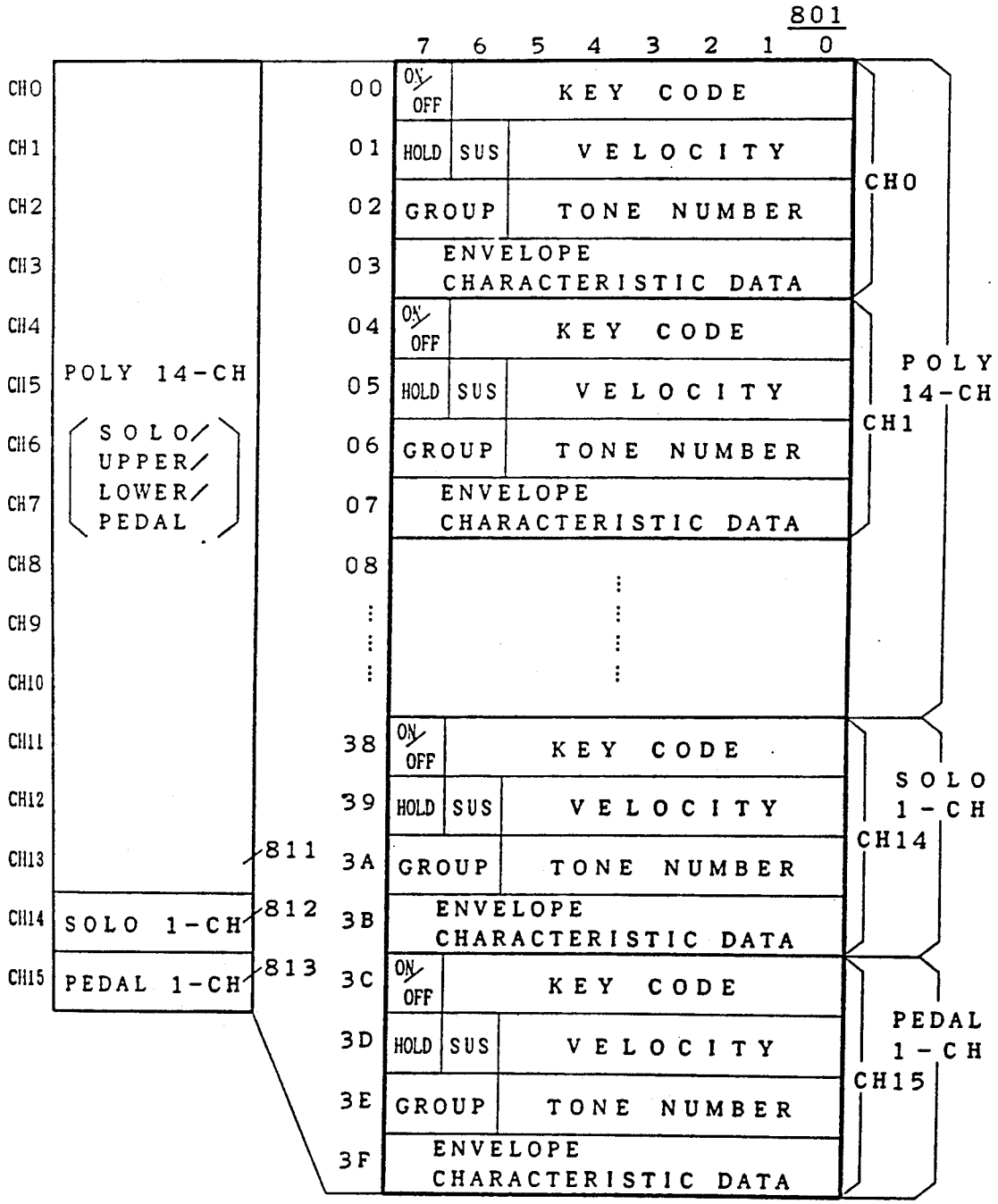
FIG. 8 is a diagram showing the contents of the assignment storing memory 801.

FIGS. 8 and 9 show the contents of the assignment storing memory 801 and the assignment buffer memory 802. These memories 801 and 802 are composed of 16 channel areas CH0–CH15. Among these channel areas, the channel areas CH0–CH13 compose the polyphonic 14-channel area 811 provided in the assignment storing memory 801 corresponding to all of the keyboards 11–14; the channel area CH14 composes the solo 1-channel area 812 provided in the memory 801 corresponding to the solo keyboard 13; and the channel area 15 composes the pedal 1-channel area provided in the memory 801 corresponding to the pedal keyboard 14.

Further, musical tone information on musical tones indicated by the keys of the upper, lower, solo and pedal keyboards 11–14 is assigned to the polyphonic 14-channel area 811; musical tone information (hereunder sometimes referred to as solo musical tone information) on musical tones indicated by only the keys of the solo keyboard 13 to the solo 1-channel area 812; and musical tone information (hereunder sometimes referred to as pedal musical tone information) on musical tones indicated by only the keys of the pedal keyboard 14 to the pedal 1-channel area 813.

In the transfer mode in which a musical tone having the solo keyboard timbre is generated by using the upper keyboard 11, the solo musical tone information is assigned to the poly 14-channel area 811 but data on the waveform of the musical tone is not read from a memory. According, the musical tone having the solo keyboard timbre is not sounded, i.e., is masked. Further, when the "UPPER to PEDAL" coupler switch **24*b* is not turned on, the pedal musical tone information is assigned to the polyphonic 14-channel area 811** but data of the waveform of the musical tone is not read from a memory. Accordingly the musical tone having the pedal keyboard timbre is not sounded, i.e., is masked.

Nevertheless, the assignment of the channel to such musical tones is effected, and thus the process of assigning the channels to the musical tones is collectively and simply performed. This is especially advantageous in the assignment of channels to MIDI musical tone information. Namely, the MIDI musical tone information can be collectively and simply processed in the same way as the musical tone information sent from the solo keyboard 13 and the pedal keyboard 14.

Even when the masking is performed in the polyphonic 14-channel area 811, the key information sent from the solo keyboard 13 and the pedal keyboard 14 is copied to the solo 1-channel area 812 and the pedal 1-channel area 813, and musical tones are sounded by using the channel areas in the coupled and normal modes. Note, in the coupled mode in which a musical tone having the upper keyboard timbre is sounded by using the solo keyboard 13 and the pedal keyboard 14, the masking process is not performed and musical tones having the solo keyboard timbre and the pedal keyboard timbre are sounded by using the polyphonic 14-channel area 811.

Furthermore, in the transfer mode, among the musical tone information generated by a simultaneous making on of several keys of the upper keyboard 11, musical tone information on musical tones having the highest pitch is assigned to the solo 1-channel area 812.

The assignment of the musical tone information to the channel areas will be described hereinbelow with reference to FIG. 8. Namely, based on the results of the key scanning effected by the key scanning circuit 10, the key information such as key codes, ON/OFF data, velocity data, and key group data corresponding to the results of the key scanning is set in the assignment storing memory 801 of the tone generator 80. On the other hand, based on the results of the scanning effected by the panel scanning circuit 20, the timbre information such as tone number data, holding data, sustain data, and envelope characteristic data corresponding to the results of the key scanning is also set in the assignment storing memory 801. This setting of the key information and the timbre information for each channel is immediate'y effected even when a musical tone assigned to the channel is being sounded.

The contents of the data stored in this assignment storing memory 801, excepting the holding data and the envelope characteristic data, are transferred or copied to the assignment buffer memory 802 without change, and musical tone signals are then generated in accordance with this data. When a musical tone relating to the assigned channel is being sounded, however the data is not copied until the termination of the sounding of the musical tone. Further, as described above, the holding data and the envelope characteristic data, which are necessary for determining whether or not the assignment of musical tone information to a channel is permitted, are not copied by this copying processing. This is because this data is not directly necessary for the generation of musical tone waveform signal and an envelope signal.

Hereinafter, the musical tone information assigned to a channel will be described in detail.

First, the ON/OFF data indicates whether the keys corresponding to the musical tone, information on which is assigned to the channel, is turned on or off (i.e., whether the keys are in a KEY ON state or KEY OFF state), and the key code indicates the pitch corresponding to each of the keys of the keyboards 11–14.

Moreover, the holding data HOLD indicates whether the envelope is an organ type (HOLD=1) as shown in FIG. 10 (*a*) in which the envelope is not decayed while the corresponding key is in the KEY ON state as shown in FIG. 10 (*a*), or a percussion type (HOLD=0) in which the envelope is decayed even when the corresponding key is in the KEY ON state as shown in FIG. 10 (*b*). For the organ type musical tone information of, the subtraction of data from the envelope characteristic data (i.e., the decay of the envelope) is started after the corresponding key is turned off of, and the next musical tone information can be assigned to a channel only after the key is turned off. In contrast, for the percussion type musical tone information, the subtraction of data from the envelope characteristic data is started even while the corresponding key is on or is turned on, and thus next musical information can be assigned to a channel even while the key is on.

The sustain data SUS is effect data indicating whether sustain effects area applied (SUS=1) or not applied (SUS=0) by turning the sustaining switch 26 on or off.

Further, the velocity data indicates the speed or strength of the pressing of the key to make it on as explained in the description of the register portion 61.

Next, the group data indicates the four groups of the musical tone information corresponding to the upper, lower, solo and pedal keyboards 11–14, i.e., to which of the four groups the musical tone information assigned to the channel belongs, as also explained in the description of the register portion 61.

Further, the tone number data indicates the difference between the timbres, i.e. the difference between the musical tone waveform and the envelope, and the contents of the musical tone waveform and the envelope are determined based on this data.

Furthermore, the percussion type envelope characteristic data corresponds to the period from the beginning of the attack time of the envelope to the termination of the release time thereof. In contrast, the organ type envelope characteristic data corresponds to the period of the release time of the envelope. By subtracting this data from the envelope at constant intervals, an operation of the envelope is simulated, and at the time of the next channel assignment, a channel is selected which corresponds to the minimum value of the envelope characteristic values, from which this data is subtracted, relating to the channels.

6. TONE COLOR COEFFICIENT DATA OF TIMBRE INFORMATION

FIGS. 1(*a*), 1(*b*) and 1(*c*) are diagrams showing lists of the tone color coefficient data of the timbre information, which comprises the tone number data, the envelope characteristic data, and the holding data and is stored in the ROM 70. The values of the color coefficient data are determined and are read out of the memory in accordance with selected switched of the panel tablet 21 and the velocity data of the keys of the keyboards 11-14.

The tone number data where the velocity data VELO exceeds the value "40H" with respect to each of various timbres NOTAB, PIANO, VIBRAPHONE . . . as shown in FIG. 1(*a*) and the tone number data where the velocity data is equal to or less than the value "40H", are stored separately in the memory. (In this specification, the subscript H indicates that a number to which the subscript H is attached is a hexadecimal.) Further, in either case, the tone number data is further divided into the compasses $C_2$-$B_3$, $C_3$-$B_4$, $C_4$-$B_5$, $C_5$-$B_6$, $C_6$-$B_7$, and the thus divided data stored separately in the memory.

Similarly, the envelope characteristic data where the sustaining data (SUS) is equal to "0" and the envelope characteristic data where the data SUS is equal to "1" are stored separately in the memory. Further, in either case, the envelope characteristic data is further divided into the compasses $C_2$-$B_3$, $C_3$-$B_4$, $C_4$-$B_5$, $C_5$-$B_6$, $C_6$-$B_7$, and the thus divided data stored separately in the memory.

Further, an envelope time is increased with this envelope characteristic data, i.e., as the pitch of a musical tone to be sounded becomes lower, this envelope time is increased. Moreover, when the sustain effect is applied to the musical tone, the value of the envelope characteristic data is increased accordingly. Furthermore, at the next assignment of the channels, a channel is selected which corresponds to the minimum value of the envelope characteristic data to be subtracted from the envelope of each channel. Thereby, the assignment of a channel can be performed by simply selecting a channel corresponding to a musical tone generated by using the envelope in which the decay has most progressed.

As described above, the envelope characteristic data is separately established for every tone, every compass, and every presence of the sustain effects. Further, the envelope characteristic data may be separately established for each velocity data, every pitch, and every state in which an effect capable of affecting other envelopes is employed.

The holding data indicated whether the envelope is the organ type or the percussion type as shown in FIG. 8. Further, the holding data does not change in accordance with the velocity data and the sustaining data as shown in FIG. 1(*c*), and thus only one value of the holding data is established for each timbre.

Note, among the above described timbres, a musical tone having the timbre "NOTAB" is assigned to a channel but is not sounded, i.e., is masked. In this case, the tone number is made equal to "00H" at all times. In the tone generator 80, even when the timbre is "NOTAB", an operation similar to an operation performed in the case of other timbres is effected. The musical tone having the timbre "NOTAB", however, is not sounded as a result of generating a waveform having a wave height of 0, by using the musical tone waveform generating circuit 807 of FIG. 11. Instead, the envelope value generated by the envelope generating circuit 806 may be made equal to 0. This masking of the musical tones is performed on musical tones corresponding to the musical tone information sent from the solo keyboard 13 and the pedal keyboard 14 and assigned to the polyphonic 14-channel area 811 in the normal and transfer modes.

In this case, the envelope characteristic data is made equal to "20H", and only the envelope is generated, because it is necessary for the processing of the updating of the contents of the channel assignment effected in the assignment buffer memory 802 by producing a release end signal, as described later, indicating that the level of the envelope is 0. Further, the organ type envelope, which does not decay while the key is on, is selected by making the holding data equal to 1, or the following reasons. Namely, if the percussion type envelope is selected, the musical tone information assigned to a channel may be eliminated at the next assignment of that channel, and thus the key information, which is assigned to the polyphonic 14-channel area 811 and is the same as the musical tone information sent from the solo keyboard 812 and the pedal keyboard 14, may not be copied to the solo 1-channel area 812 and to the pedal 1-channel area 813 in the transfer mode.

7. TONE GENERATOR 80

Figure 11:
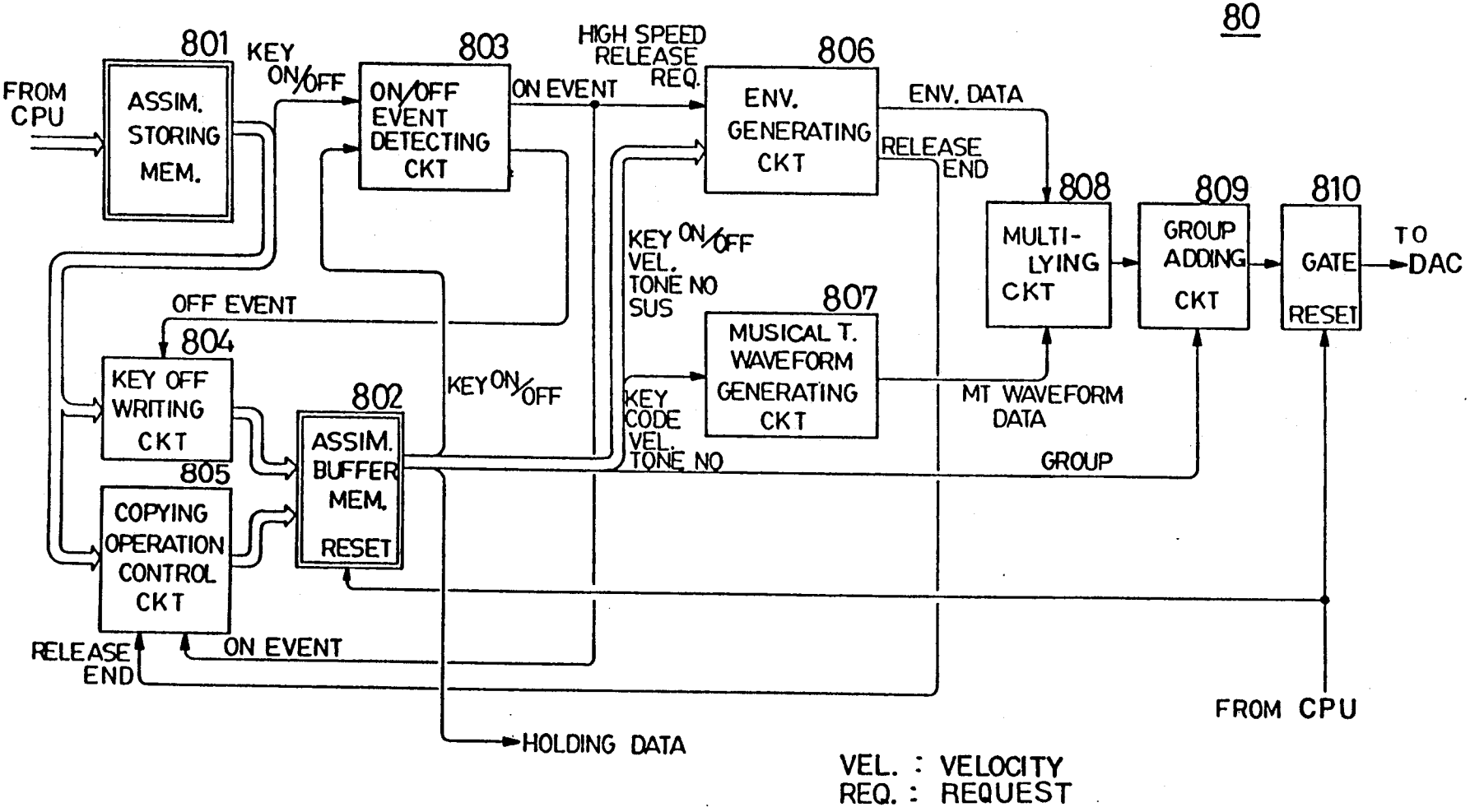
FIG. 11 is a schematic block diagram showing the whole construction of the tone generator 80.

FIG. 11 is a schematic block diagram showing the entire construction of the tone generator 80. The musical tone information preset at every channel in the assignment storing memory 801 by the CPU 50 is transferred and copied to the assignment buffer memory 802 by a copying operation control circuit 805. This transfer and copying processing is performed with respect to the channel only when the release end signal output fron the envelope generating circuit, as described later, is input to this copying operation control circuit 805, and in addition, an ON-EVENT signal output by an ON/-OFF EVENT detecting circuit 803 is input thereto. Therefore, even where the ON-EVENT signal is input thereto, if the release end signal is not input, the copying operation control circuit 805 does not carry out the transfer and copying operation.

Further, in the musical tone information transferred and copied to the assignment buffer memory 802, the key code, the velocity data, and the tone number data relating to the musical tone waveform are input to a musical tone waveform generating circuit 807. Then data indicating the corresponding musical tone waveform (hereunder sometimes referred to as waveform data) is read therefrom at a rate such that the musical tone has a pitch corresponding to the key code, and is further input to a multiplication circuit 808. Further, the data relating to the ON/OFF state of the key, the velocity data, the tone number data, and the sustain data relating to the envelope are input to the envelope generating circuit 806, whereupon data representing a corresponding envelope (hereunder sometimes referred to as envelope data) is generated. The thus generated envelope is then sent to the multiplication circuit 808, whereupon the musical tone waveform data is multiplied by the envelope data. Thereafter, data representing the results of the multiplication classified by the groups of musical tones corresponding respectively to the upper, lower, solo and pedal keyboards 11-14 is added to other data belonging to the same group by a group data adding circuit 809, and result of this addition is output to the DA controller 90 through a gate circuit 810.

Figure 12:
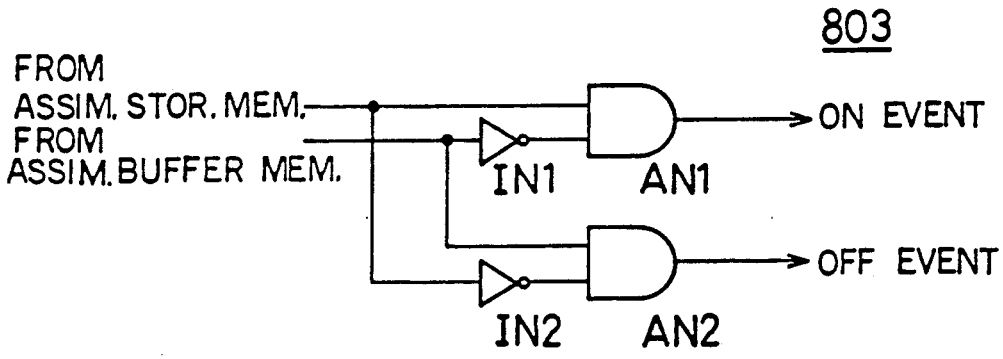
FIG. 12 is a circuit diagram of an ON/OFF EVENT detecting circuit 803.

The ON/OFF data included in the musical tone information read out of the assignment storing memory 801 and that included in the musical tone information read out of the assignment buffer memory 802 are input to the ON/OFF EVENT detecting circuit 803 and compared. Where the ON/OFF data from the memory 801 is "1" and the ON/OFF data from the memory 802 is "0", an ON-EVENT signal is output therefrom. In contrast, where the ON/OFF data from the memory 801 is "0" and the ON/OFF data from the memory 802 is "1", an OFF-EVENT signal is output therefrom. This ON/OFF EVENT detecting circuit 803 may comprise AND gates AN1 and AN2 and inverters IN1 and IN2, as shown in FIG. 12.

Figures 3A, 3B:
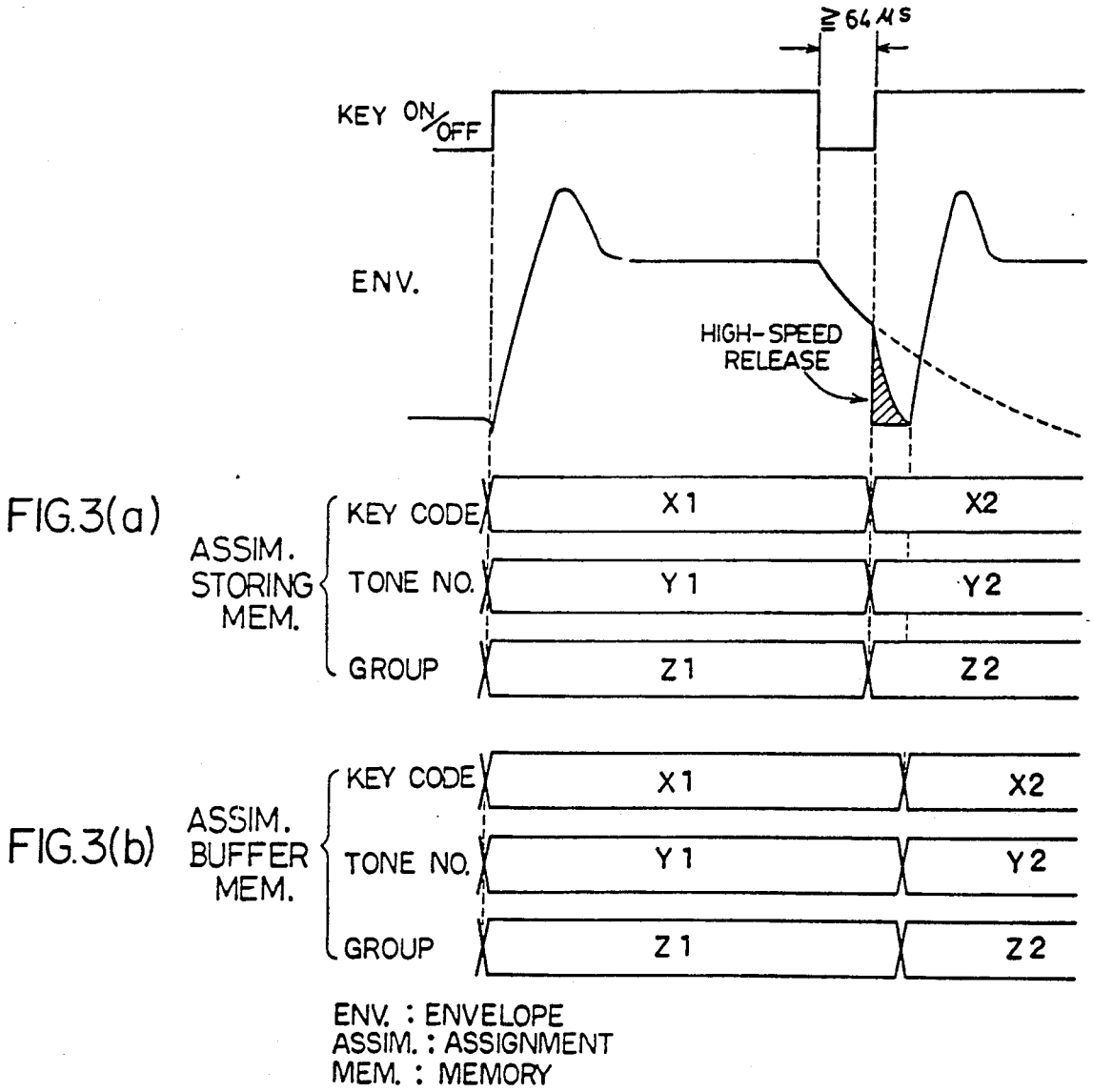
FIGS. 3(*a*) and (*b*) are is a diagrams showing the difference in time between the assignment of the same musical tone information to channel areas of an assignment storing memory 801 (FIG. 3(*a*)) and that of the same musical tone information to channel areas of a tone generator 80 (FIG. 3(*b*))

The ON-EVENT signals are input to the copying operation control circuit 805 as described above, and are further input to the envelope generating circuit 806 as high-speed release request signals, resulting into an abrupt lowering of the level of the envelope, as shown in FIG. 3. When the envelope level becomes "0" in the envelope generating circuit 806, the release end signal for each channel is output therefrom to the copying operation control circuit 805.

The OFF-EVENT signal is fed to a KEY OFF data writing circuit 804, and then the ON/OFF data and the key code corresponding to the channel in question, which are input from the assignment storing memory 801, are written to a corresponding channel area of the assign buffer memory 802. This process is performed separately from the transfer and copying operation effected by the copying operation control circuit 805, because there is no need to form a queue of the ON/-OFF data during the high-speed release.

Among the musical tone information read from the assignment buffer memory 802, the group data used for differentiating between the musical tones corresponding respectively to the upper, lower, solo and pedal keyboards 11-14 are input to the group adding circuit 809, whereupon the musical tone signals are classified into groups corresponding respectively to the keyboards 11-14, and further, data indicated by the musical tone signals of each of these groups is accumulated. Furthermore, in the musical tone information read from the assignment buffer memory 802, the holding data is input to the sound generating system 100, to thereby control the processing of the holding of the envelope level. Further, at the time of turning on the power, a reset signal is output from the CPU 50 for a constant period to the assignment buffer memory 802 and the gate circuit 810, to lock them such that noise signals are not output.

8. COPYING OPERATION CONTROL CIRCUIT 805 AND KEY OFF DATA WRITING CIRCUIT 804

Figure 19:
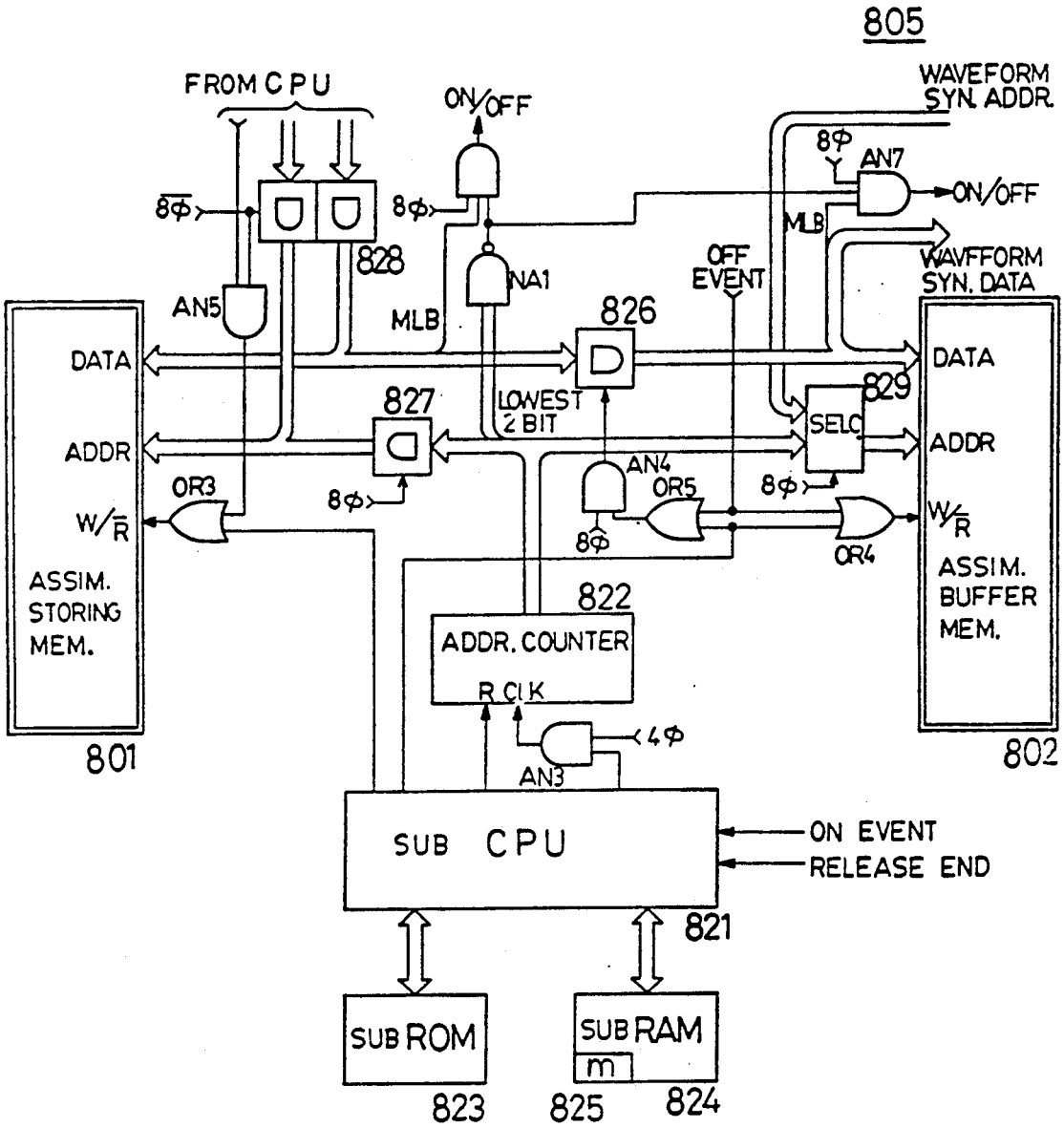
FIG. 19 is a circuit diagram of a copying operation control circuit 805 and a KEY OFF writing circuit 804.

FIG. 19 is a schematic block diagram showing the construction of the copying operation control circuit 805 and the KEY OFF data writing circuit 804. The copying operation controlling circuit 805 may be composed of a sub-CPU or coprocessor 821, a sub-ROM 823, a sub-RAM 824, and the address counter 822 and so on. The number counted by the address counter 822 at a rate, which is four times one channel period which is synchronized with a clock signal 4ϕ input through an AND gate AN3 thereto, is input to the assignment storing memory 801 and the assignment buffer memory 802, thereby performing the reading and copying of the musical tone information for both the assignment storing memory 801 and the assignment buffer memory.

Further, the address data supplied to the assignment storing memory 801 is output therefrom through a group of AND gates 827 every time a clock signal 8ϕ having a frequency twice that of the clock signal 4ϕ is input. Moreover, the assignment storing memory 801 is alternately occupied by the CPU 50 and the sub-CPU 821 every time the clock signal 8ϕ and the signal obtained by inverting the signal 8ϕ are input in a time sharing manner.

Furthermore, the address data supplied to the assignment buffer memory 802 is output therefrom through a selector 829, through which address data used for synthesizing waveform and output by a timing generator for synchronizing the components of the whole system with each other is fed to the assignment buffer memory 801. By using this address data, the data read out of the assignment buffer memory 801 is input to the envelope generating circuit 806 and the musical tone generating circuit 807, whereupon the data is classified into groups corresponding to the keyboards 11-14, and the data of each of the groups is accumulated, synthesized, and then output therefrom.

The clock signal 8ϕ is input to the selector 829, as a selecting signal. Namely, every time the clock signal 8ϕ is input, address data from the address counter 822 is selected therein, and every time the signal obtained by inverting the clock signal 8ϕ therein is input, address data input from the timing generator is selected.

On the other hand, write/read command signals W/R are input to the assignment storing memory 801 through an OR gate OR3, and to the assignment buffer memory 802 through an OR gate OR4, such that these memories are in a write cycle when the level of the signal W/R is high (corresponding to "1") and in a read cycle when the level of the signal W/R is low (corresponding to "0"). Among these signals W/R, the write/read command signal W/R to be input to the assignment buffer memory 802 is input through an OR gate OR5 and an AND gate AN4 to a group of AND gates 826 when the clock signal 8ϕ is input as an enable signal, whereby data from the assignment storing memory 801 is copied to the assignment buffer memory 802.

The programs, etc., used by the sub-CPU 821 to perform the copying processing are stored in the sub-ROM 823. On the other hand, various intermediate processing data are stored in the sub-RAM 824. Further, an m-register 825 of the sub-RAM 824 is used for performing the processing of copying data from the assignment storing memory 801 to the assignment buffer memory 802.

When data is written by the CPU 50 to the assignment storing memory 801, the write/read command signal W/R is input thereto through the AND gate AN5 and the OR gate OR3. On the other hand, the address data and other data to be written thereto are input through a group of AND gates 828. The AND gate AN5 and the group of AND gates 828 are enabled when the signal obtained by inverting the signal 8ϕ is input thereto.

Further, the OFF-EVENT signal is input to the assignment buffer memory 802 through the OR gate OR4 as a write command signal, and is further input to the group of the AND gates 826 through the AND gate AN4 when the clock signal 8ϕ is input as an enable signal. Accordingly, the KEY OFF data and the key code are copied from the assignment storing memory 801 to the assignment buffer memory 802.

The value indicated by the most significant bit (MSB) of the data read from the assignment storing memory 801 is output therefrom through an AND gate AN6 when the clock signal 8ϕ is input thereto. Data indicated by the lowest two bits of the address data from the address counter 822 is input to this AND gate AN6 through an NAND gate NA1, as an enable signal. Thus, the highest order ON/OFF data of the addresses "00H", "04H", "08H" . . . "3CH", where the lowest two bits of the address data are "00", is selected and output.

The value indicated by the MSB (MLB) of the data read from the assignment storing memory 802 is output therefrom through an AND gate AN7 when the clock signal 8ϕ is input thereto. Data indicated by the lowest two bits of the address data from the address counter 822 is input to this NAND gate AN7 through the NAND gate NA1, as an enable signal, and thus the highest order ON/OFF data of the addressed "00H", "04H", "08H" . . . "3CH", where the lowest two bits of the address data are "00", is selected and output.

Note, the KEY OFF data writing circuit 804 may be included in the copying operation control circuit 805. Further, as shown in steps 604 and 605 of FIG. 18, the ON/OFF data may be written by executing a program. Furthermore, the configurations of the circuits 804 and 805 is not limited to those described above.

Furthermore, the address counter 822 may be a 4-bit type, and data "00" input from the group may be added to the contents of such an address counter as the lowest two bits of data indicated by the address counter, and the thus generated data may be output to the assignment storing memory 801 and the assignment buffer memory 802, and thus the NAND gate NA1 can be omitted. In this case, a clock signal to be input to the address counter 822 through the AND gate AN3 may have a period which is equal to one channel period or may be a signal having another period.

Hereinafter, an operation of this embodiment will be described.

9. INITIALIZATION ROUTINE

Figure 13:
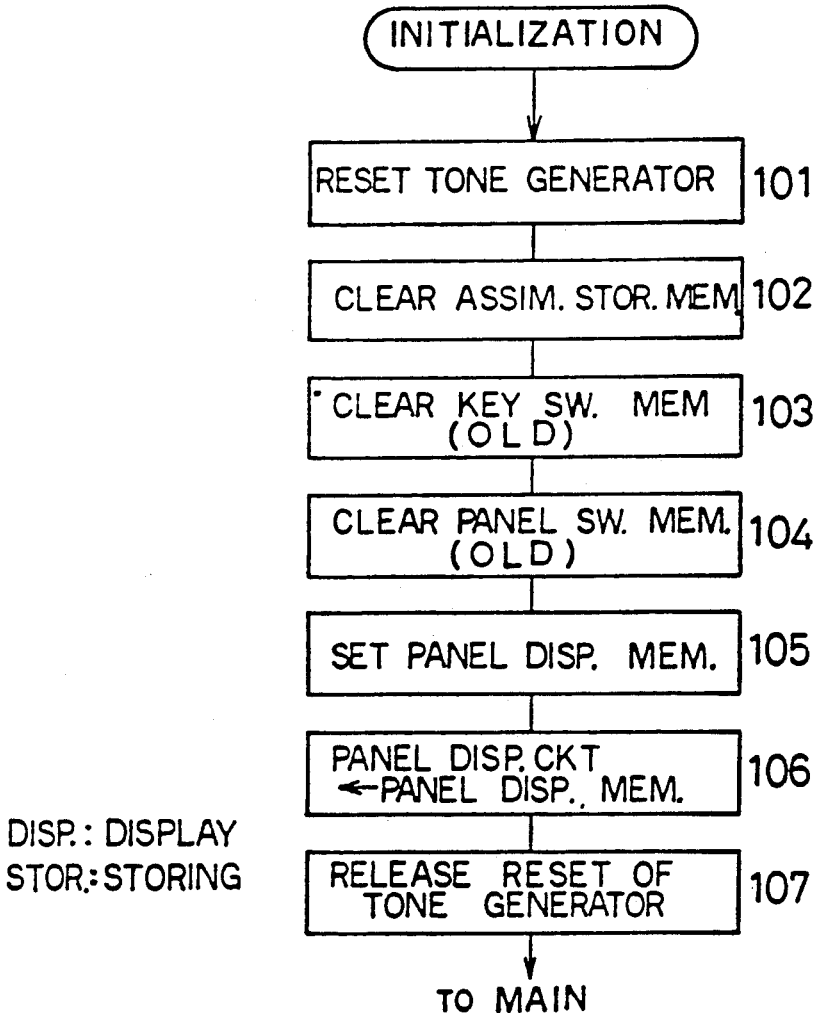
FIGS. 13, 14A, 14B, 15A, 15B, 16A, 16B, 17 and 18 are flowcharts of an initialization routine, a main routine, a subroutine for assignment of the musical tone information to a polyphonic 14-channel area 811, a subroutine for assignment of the musical tone information to a solo 1-channel area 812, a subroutine for envelope characteristic data subtracting processing, and a subroutine for copying information from the assignment storing memory 801 to the assignment buffer memory 802, respectively.

FIG. 13 is a flowchart of an initialization program of this embodiment. First, the CPU 50 commences the initialization processing after the power is turned on. The initialization routine then goes to step 101, whereupon the CPU 50 constantly outputs reset signals to the copying operation control circuit 805 and the gate circuit 810, to prevent the output of noise signals. Next, the routine goes to step 102, where the CPU 50 clears the assignment storing memory 801, and subsequently, the CPU 50 clears the key switch memory 62 in step 103, and further, clears the panel switch memory 63 in step 104. Furthermore, the CPU 50 initializes the panel display memory 64 in step 105. At that time, the coupler switches **24*a* and 24*b*, the transfer switch 25 and the sustain switch 26 are off (corresponding to level "0"). With respect to the tone color selecting switches 23, the switches or keys shown in the left upper portion of FIG. 5**(*a*)–(*d*) are selected. Namely, the switch or key STRINGBASS is selected at the pedal keyboard 14; PIANO at the upper keyboard 11; VIOLIN at the solo keyboard 1; and PIANO at the lower keyboard 12. Thereafter, the CPU transfers all of the data of the panel display memory 64 to the panel display circuit 30 in step 106, and further, stops the output of the reset signals to the circuits 805 and 810 of the tone generator 80 in step 107. Next, the execution of a main routine in this embodiment will be explained hereinbelow.

10. MAIN ROUTINE

Figure 14A:
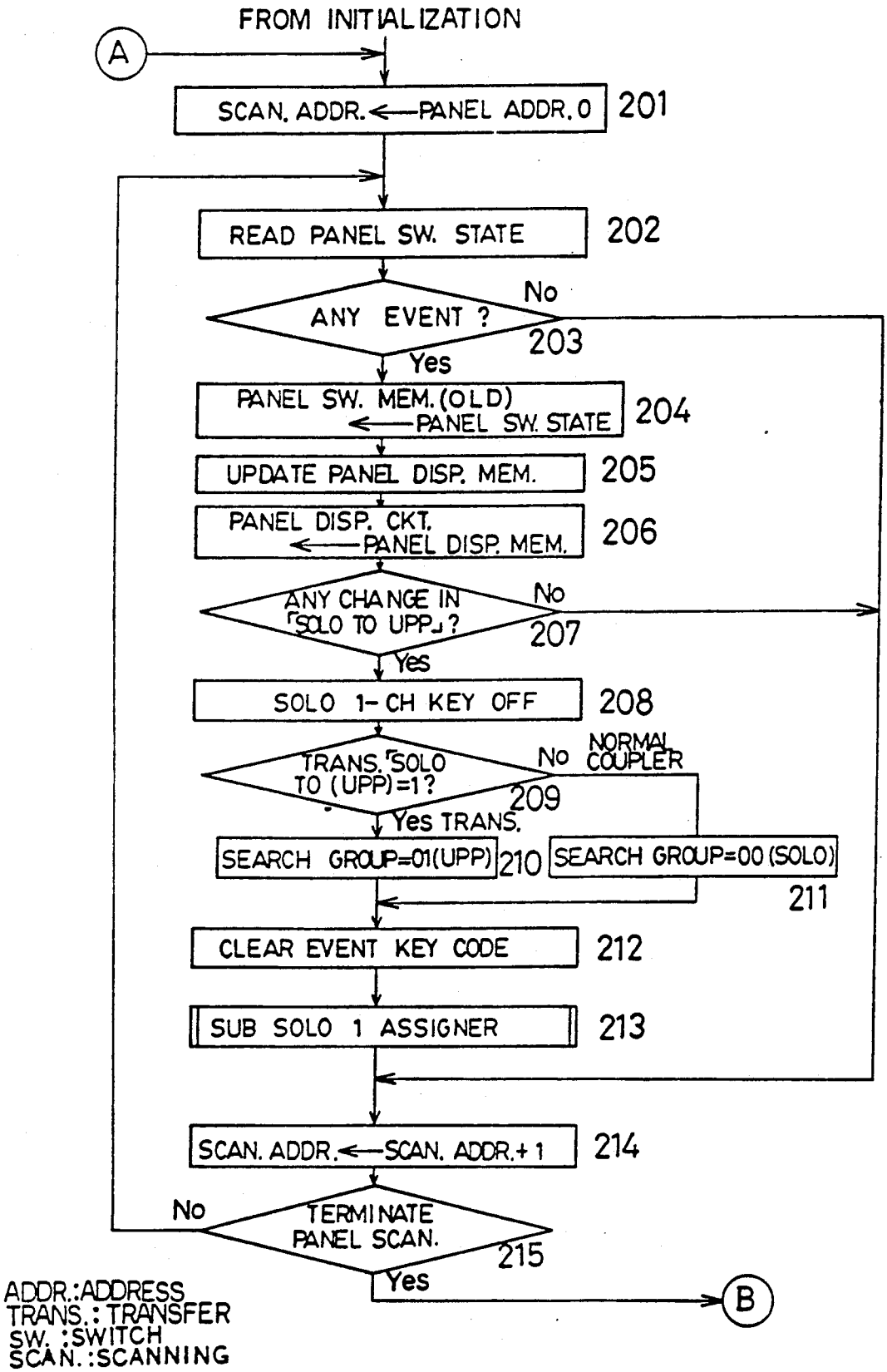
Figure 14B:
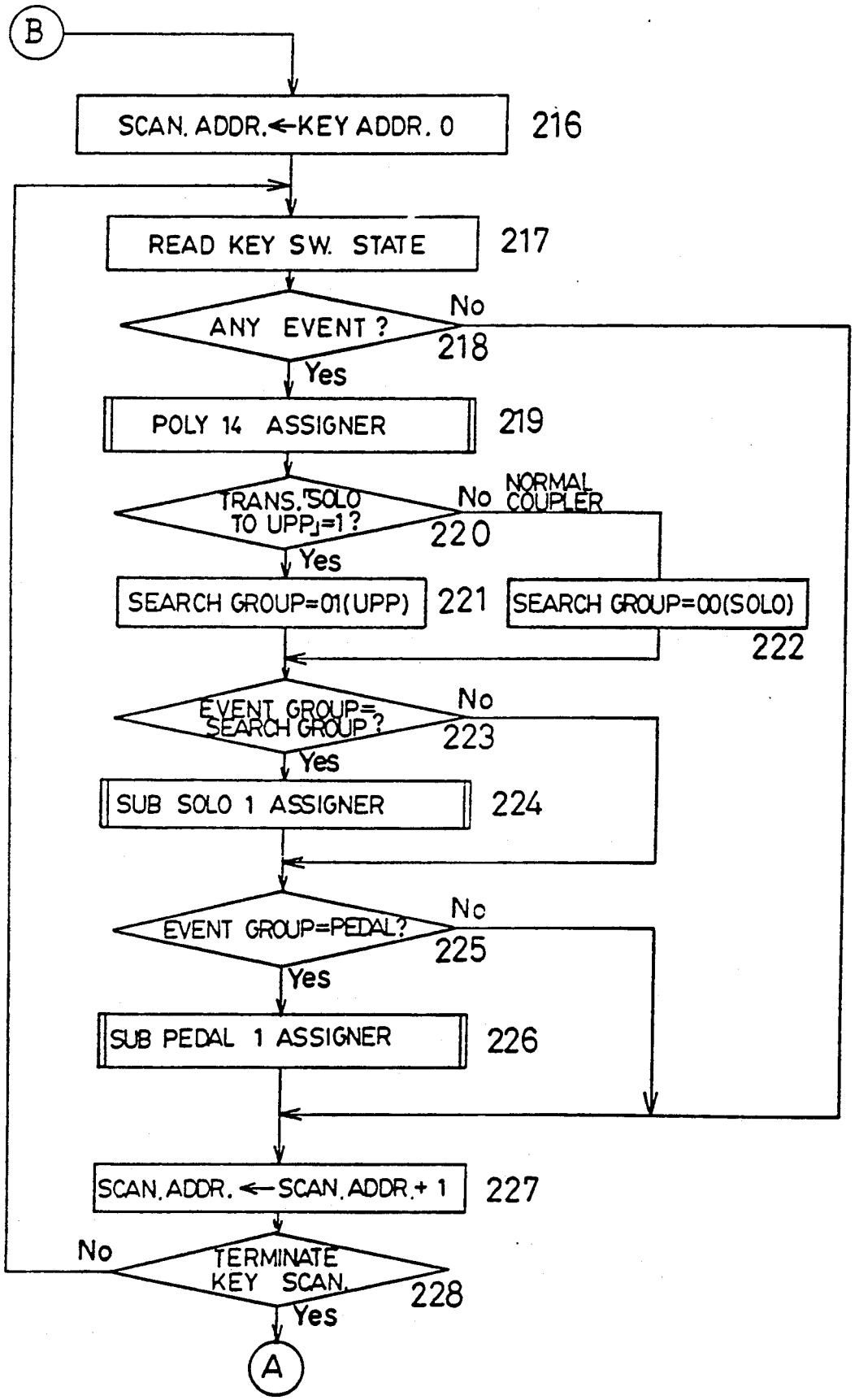

In summary, in steps 201–206 of this routine, shown in FIGS. 14A and 14B, the processing is effected in accordance with the instructions given through the switches of the panel tablet 21. Further, in steps 207–213, new key information to be assigned to the solo 1-channel area 812 in response to a change in the ON-state or OFF-state of the transfer switch 25 is set as the key information corresponding to the upper keyboard 11 where the switch 25 is in the ON-state, and in contrast, is set to be that corresponding to the solo keyboard 13 where the switch 25 is in the OFF-state. Thereafter, in steps 216–228, the processing of assigning the musical tone information to the polyphonic 14-channel area 811, the solo 1-channel area 812, and the pedal 1-channel area 813 is effected in response to operations of the keys of the keyboards 11–14.

10.1 PROCESS OF SCANNING PANEL TABLET 21 (Steps 201–215)

As mentioned above, FIGS. 14(*a*) and (*b*) are is a flowchart of the main routine wherein, first the routine enters step 201, where the CPU 50 sets a scanning address of the register portion 61 to "0". Then, the CPU to outputs this scanning address data to the panel scanning circuit 20, and further, receives date (hereunder sometimes referred to as resultant data) representing the results of the scanning, i.e. indicating the ON-states or OFF-states of the switches of the panel tablet 21 corresponding to the scanning address data therefrom, at step 202. The main routine then advances to step 203, where this resultant data is compared with the old (current) ON/OFF data of the switches of the panel tablet 21 stored at the address of the panel switch memory 63 corresponding to the scanning address, and it is determined whether there is any difference between the contents of this data.

If a difference exists, it is concluded that there has been an ON-EVENT or OFF-EVENT, and the routine then goes to step 204, i.e., the result at step 203 is "YES", where the CPU 50 sets a flag of an event bit in the register portion 61 and writes the received new resultant data to a scanning address area of the panel switch memory 63. Further, the same processing is also performed for the panel display memory 64, in step 205, and the new content of the data stored in the panel display memory 63 is output to the panel display circuit 30, in step 206, and accordingly, the LEDs 22 can be turned on in accordance with the new state of the switches of the panel tablet 21.

Next, the main routine advances to step 207, where the CPU 50 determines whether any change has occurred in the states of the "SOLO to UPPER" transfer switch 25, in response to the updating of the on or OFF states of the switches of the panel tablet 21. If a change has occurred, the main routine goes to step 208, where the CPU 50 forcibly makes the ON/OFF data stored in the solo 1-channel area 812 equal to "0" (corresponding to the OFF state). This is because it is necessary to take the key information (hereunder sometimes referred to as upper key information or solo key information) of the upper keyboard 11 or the solo keyboard 13 into the solo 1-channel area 812 or exchange this information as shown in FIGS. 2(*a*) and 2(*c*) as a result of a change in the ON-state or OFF-state of the transfer switch 25.

Further, in step 209, the CPU 50 determines whether the transfer switch 25 corresponding to the address "3" of the panel switch memory 63 or the panel display memory 64 is in the ON-state (indicated by "1"). If the switch 25 is in the ON-state, the search group data is set to "1" (indicating the group corresponding to the upper keyboard 11). In contrast, if the switch 25 is in the OFF-state, the search group data is set to "00" (indicating the group corresponding to the solo keyboard 13), in step 211. This is because the new key information to be assigned to the solo 1-channel area 812 is set as the upper key information when the switch 25 is in the ON-state, and is set as the solo key information when the switch 25 is in the OFF-state, as a result of a change in the ON/OFF state of the switch 25, in a later step 213.

Next, in step 212 the CPU 50 clears the flag of the event bit set in the register portion 61, and then in step 213 carries out the processing of assigning musical tone information to the solo 1-channel area 812, to assign new musical tone information corresponding to the change in the ON-state or OFF-state of the transfer switch 25 to the solo 1-channel area 812. Further, the processing of scanning the panel tablet 21 is repeatedly performed while the scanning address is changed from the address "0" of the panel switch memory 63 to the address "7" thereof (steps 214 and 215).

10.2 PROCESSING OF KEYBOARDS 11-14 (STEPS 216-228)

Upon completion of the processing of scanning the switches of the panel tablet 21, the CPU 50 starts the processing of scanning the keys of the keyboards 11-14. Namely, the main routine enters step 216 and the CPU 50 sets the scanning address of the register portion 61 as "0", outputs this scanning address to the key scanning circuit 10, and then receives inputs of the resultant data indicating the ON/OFF states of the keys of the keyboards 11-14 corresponding to the scanning address therefrom, in step 217. The main routine then goes to step 218, where the resultant data is compared with the old (current) ON/OFF data of the switches of the keyboards 11-14, stored at the address of the key switch memory 62 corresponding to the scanning address, and it is determined whether there is any difference between the contents of these data.

If a difference exists, it is concluded that an ON-EVENT or OFF-EVENT has occurred. The routine then goes to step 219, and the CPU 50 sets a flag of an event bit in the register portion 61. Further, the key assigning processing is performed on the polyphonic 14-channel 811. Thereby, the processing of assigning musical tones to the channels of all of the upper, lowers, solo and pedal keyboards 11-14, is collectively effected by using the polyphonic 14-channel area 811.

Further, in step 220, the CPU 50 determines whether the transfer switch 25 corresponding to the address "3" of the panel switch memory 63 or the panel display memory 64 is in the ON-state (indicated by "1"). If the switch 25 is in the ON-state, the search group data is set to "01" (indicating the upper group corresponding to the upper keyboard 11) in step 221. In contrast, if the switch 25 is in the OFF-state, the search group data is set to "00" (indicating the group corresponding to the solo keyboard 13) in step 222. This is because the new key information to be assigned to the solo 1-channel area 812 is set as the upper key information as shown in FIG. 2(*c*) when the switch 25 is in the ON-state, and is set as the solo key information as shown in FIG. 2(*a*) when the switch 25 is in the OFF-state, as a result of a change in the ON/OFF state of the switch 25, in a later step 224.

Next, in step 223, the CPU 50 determines whether or not the keyboard group in which an event has occurred matchs the group set in step 221 or 222 and next searched. If both thereof indicate the upper group, the musical instrument is in the transfer mode, as apparent from steps 220 and 221, and thus in step 224, the upper key information from the upper keyboard 11 is assigned to the solo 1-channel area 812 as shown in FIG. 2(*c*). If both thereof indicate the solo group, the musical instrument is in the normal or coupled mode as apparent from steps 220 and 222, and thus as shown in FIGS. 2(*a*) and 2(*b*), the solo key information from the solo keyboard 13 is assigned to the solo 1-channel area 812 in step 224. If a match there between cannot be made the solo keyboard 13 may be operated in the transfer mode or the upper keyboard 11 may be operated in the normal or coupled mode. In this case, as shown in FIG. 2, the assignment of the information to the solo 1-channel area 812 is not necessary, and this the process of assigning the information to the solo 1-channel area 812 in step 224 is not performed.

Thereafter, in step 225, the CPU 50 determines whether or not the keyboard in which an event has occurred is the pedal keyboard 14. If the result is affirmative, the process of assigning the information to the pedal 1-channel area 813 is effected in step 226. This assignment process is similar to the process of assigning the information to the solo 1-channel area 813. Further, the process of scanning the keyboards 11-14 is repeatedly performed with respect to the scanning address, from the address "0" of the key switch memory 62 to the address "1FH" thereof (steps 227 and 228).

11. PROCESS OF ASSIGNING MUSICAL TONE INFORMATION TO POLYPHONIC 14-CHANNEL AREA 811

In this process a search a channel area corresponding to the characteristic data of the envelope, which is most easily decayed, is made in steps 310-318. Further, in steps 319-324, the musical tone information is assigned to the thus-searched channel area, and in steps 301-309, a KEY OFF processing is effected.

11.1 KEY OFF EVENT PROCESSING (STEPS 301-309)

Figure 15A:
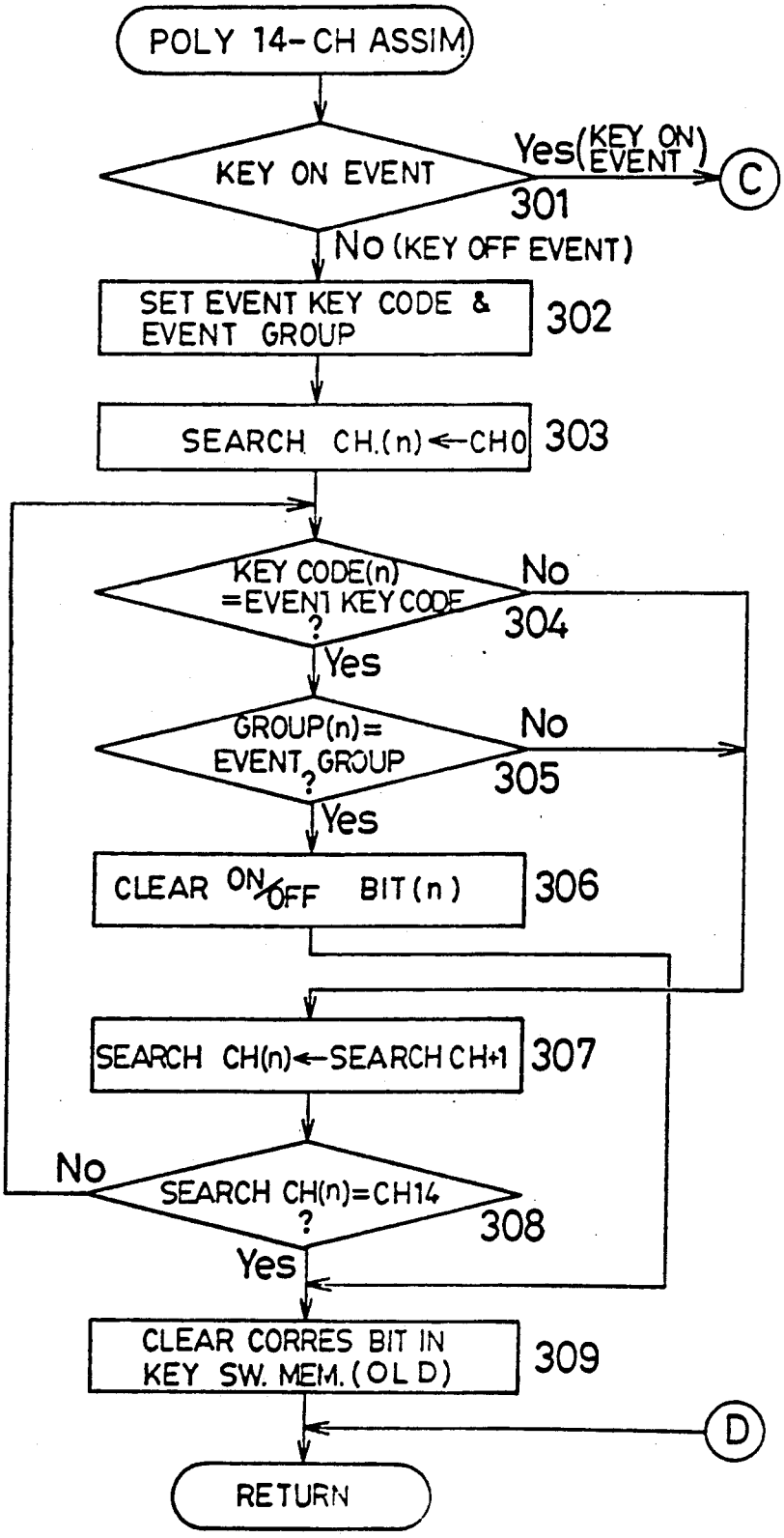
Figure 15B:
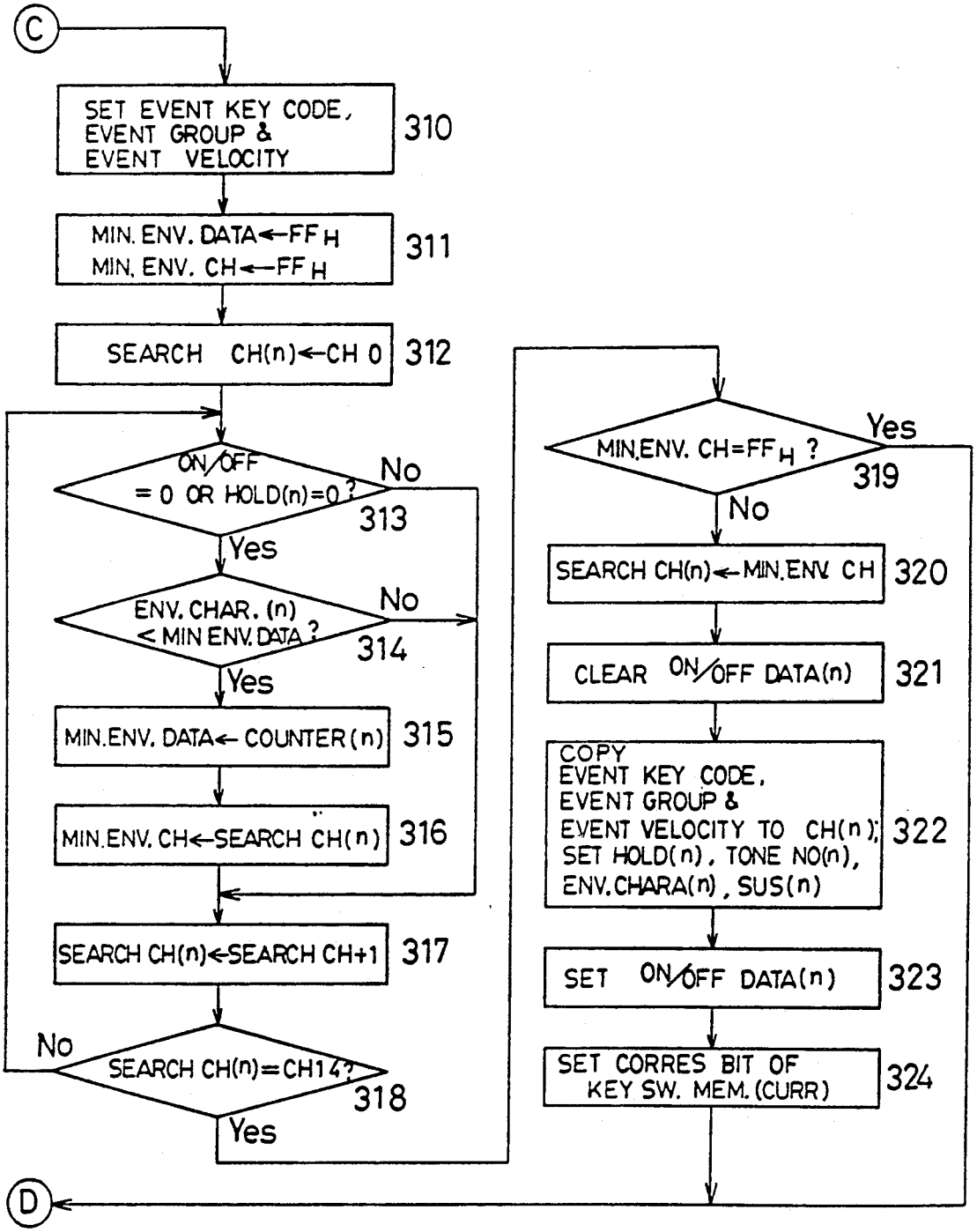

FIGS. 15A and 15B are a flowchart of the subroutine of the process of assigning the musical tone information to the polyphonic 14-channel area 811. First, in step 301, the CPU 50 determines whether or not the event determined in the step 218 is a KEY ON EVENT. This determination can be effected by, for example, comparing the size of the ON/OFF data of the key newly received from the key scanning circuit 10 with that of the ON/OFF data of the key currently stored in the key switch memory 62, or by determining whether the difference there between is positive or negative.

If the event is determined to be a KEY OFF EVENT, the CPU sets data indicating the code of the key and the group of the keyboard in which the event has occurred in the register portion 61 in step 302, and further, sets the searching channel (n) of the register portion 61 as "0" in step 303. Then, in step 307, this value is incremented by 1, and by reiterating steps 304-308 and using a key code which is the same as the event key code, a search for a channel area having the musical tone information of the group which is the same with the event group is made among the channel areas 0-13 of the polyphonic 14-channel area 811.

Further, if a channel area having the same key code and group is found, the ON/OFF data of this channel area is cleared in step 306. Then the state of the musical tone corresponding to this channel area is changed from the KEY ON state to the KEY OFF state, and accordingly, the bit data stored in the corresponding address of the key switch memory 62 is cleared in step 309. Thereafter, the program returns to the main routine.

11.2 KEY ON EVENT PROCESSING (STEPS 310-324)

Where the event is determined to be a KEY ON EVENT in step 301, the CPU 50 sets the key code of the key relating to the occurred event the group of the keyboard in which the event occurred, and the event velocity data in the register portion 61 in step 310, and further, sets each of the minimum envelope characteristic data and the minimum envelope characteristic channel of the register portion 61 as "FFH" in step 311. This value "FFH" is the maximum envelope characteristic data and is so large that minimum envelope characteristic data having such a value cannot exist.

Next, the CPU 50 sets the searching channel (n) of the register portion 61 to "0" in step 312, then, in step 317, this value is serially incremented by 1, and by repeatedly executing steps 313-318, a channel area having the minimum envelope characteristic data, which corresponds to the percussion type envelope having the ON/OFF data "0" (corresponding to the OFF-state) or having the holding data "0" (corresponding to the ON-state), and to which musical tone information can be newly assigned, is serially searched for among the channel areas 0-13 of the polyphonic 14- channel area 811. Further, if a channel area having even smaller envelope characteristic data is found in step 314, this search is performed by setting the thus found envelope characteristic data as a new minimum envelope characteristic data in step 315, and further, setting the corresponding channel number as a new minimum envelope characteristic channel number in step 316.

Therefore, among the musical tones relating to each channel, a musical tone corresponding to the envelope which is most easily decayed can be found by searching for the minimum envelope characteristic data, because the envelope characteristic data is obtained by simulating the envelope of the musical tone corresponding to each channel.

When the channel area corresponding to the musical tone the corresponding which envelope is most easily decayed, is thus found, the CPU 50 determines whether or not the minimum envelope characteristic channel is still "FFH", in step 319: if still "FFH", the program indicates that there are no channels to which the musical tone information can be assigned, and returns to the main routine, and if not "FFH", indicates that a channel exists to which the musical tone information can be assigned. Therefore, the CPU 50 sets the minimum envelope characteristic channel thus searched for in the searching channel (n) register of the register portion 61, in step 320. Further, in step 321, the ON/OFF data of the thus found channel is cleared. In this step, however, this ON/OFF data may be cleared only when this ON/-OFF data is equal to "1".

The program then advances to step 322, whereupon the data stored in the event key code register, the event group register and the event velocity data of the register portion 61 are copied to the thus searched for channel area, and then the tone number data, the envelope characteristic data and the holding data shown in FIG. 1 are read from the ROM 70 accordance with the tone color data, the sustain data, the key code and the velocity data of the area corresponding to the group data of the panel switch memory 63, and are set in the thus found channel area. Note, the sustain data selected by the panel switch memory 63 is set therein.

Moreover, in step 322, where this embodiment is in the coupled mode when the event group data is the solo group or the pedal group, the musical tone is not sounded by using the solo or pedal keyboard timbre but by using the upper keyboard timbre. Therefore, the tone number data, the envelope characteristic data and the holding data are not determined on the basis of the tone color data selected by the solo or pedal switch of the panel tablet 21 but on the basis of the tone color data selected by the switches. Further, at that time, if this embodiment is not in the coupled mode but in the normal or transfer mode, the musical tone cannot be sounded by using the upper keyboard timbre from the solo keyboard 13 and the pedal keyboard 14. With respect to the tone number data, the envelope characteristic data and the holding data are set in the thus found channel area, the timbre "NOTAB" is selected, and this data is masked.

Thus, the key information from the solo keyboard 13 and the pedal keyboard 14 is set in the polyphonic 14-channel area 811 in any mode, as shown in FIGS. 2(*a*), 2(*b*) and 2(*c*). The key assigning processing for the polyphonic 14-channel area 811 is performed not only on the data corresponding to the upper keyboard 11 and the lower keyboard 12 but also on the data corresponding to the solo keyboard 13 and the pedal keyboard 14. In addition, the scanning processing and the assignment processing can be collectively performed for all of the keyboards 11-14, and therefore, the necessity of separately performing such processing on the data of each of groups respectively corresponding to the keyboards 11-14 is avoided, and thus the contents of such processed and the constructions of the circuits of the electronic musical instrument can be simplified.

Thereafter, the CPU 50 sets the ON/OFF data of the channel area to which the above described musical tone information is assigned to the on-state (corresponding to "1"), in step 323, clears the bit data stored at the corresponding address of the key switch memory 62 in step 324, and the program then returns to the main routine.

If the period from the key off time of the latest assigned musical tone (i.e., step 321) to the setting of the ON/OFF data to the ON-state in state in step 323 is less than 64 microseconds (μs) as shown in FIG. 3, the setting of the date is delayed by that period, and the ON/OFF date made on thereafter. This prevents the sounding of one musical tone from overlapping that of the next musical tone. Note, this standby time may be 48 μs or another appropriate time.

12. PROCESS OF ASSIGNING MUSICAL TONE INFORMATION TO SOLO 1-CHANNEL AREA 812

In this process, in the transfer mode, the musical tone information of the channel area corresponding to the musical tone having the highest pitch in the polyphonic 14-channel area 811 is copied to the solo 1-channel area 812 in steps 401–414; on the other hand, in the coupled mode, the musical tone information of the channel area corresponding to the solo keyboard timbre of the polyhonic 14-channel area 811 is copied to the solo 1-channel area 812 in steps 401–414; and in the normal mode, the musical tone information of the channel area corresponding to the solo keyboard timbre of the polyphonic 14-channel area 811 is copied to the solo 1-channel area 812 in steps 401–416, and in steps 420–427, a key off process is effected. If the key off is that effected by turning off one of several keys pressed at the same time, musical tones having the solo keyboard timbre in the polyphonic 14-channel area 811 exist, and the copying of the information to the corresponding solo 1-channel area 812 is performed in steps 422–425 and 412–414.

12.1 KEY ON EVENT PROCESSING (STEPS 401–416)

Figure 16A:
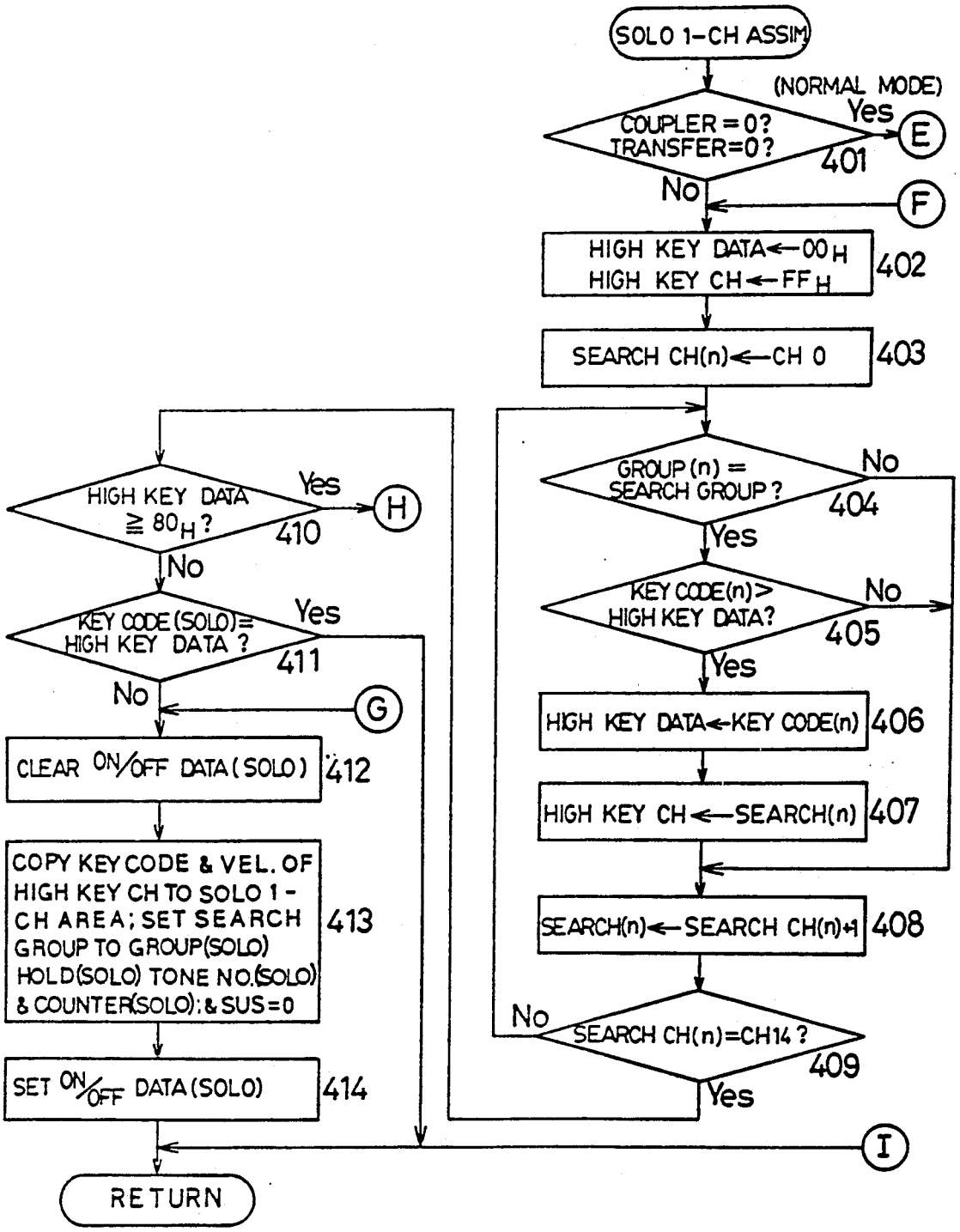
Figure 16B:
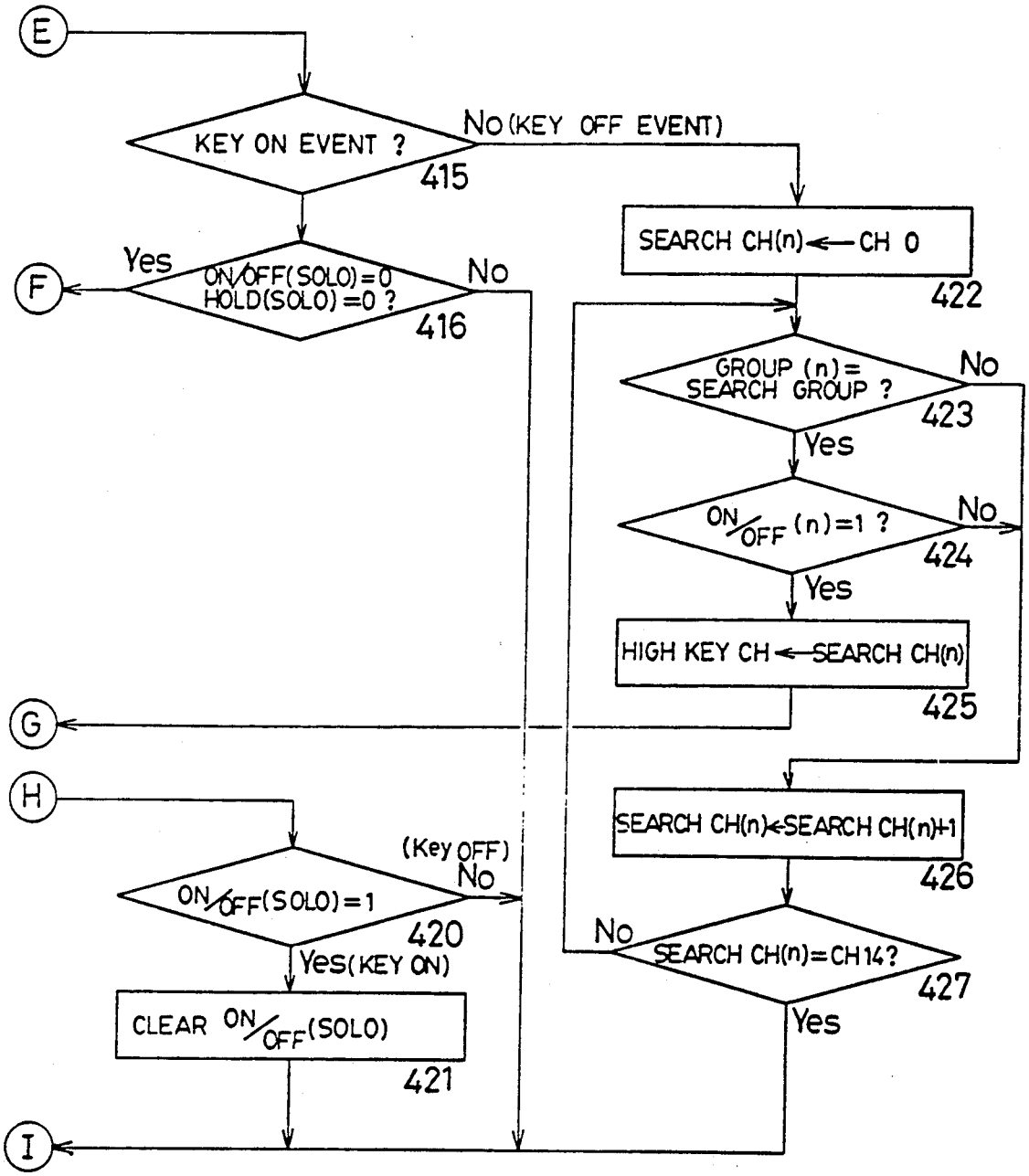

FIGS. 16A and 16B is a flowchart of the process of assigning the musical tone information to the solo 1-channel area 812. First, in step 401 the CPU 50 determines whether the coupler switch 24*a* and the transfer switch 25 are in the OFF-state in the normal mode, and either thereof is in the ON-state, or in the coupled or transfer mode, the key information assigned to one channel area of the polyphonic 14-channel area 811 must be copied to the solo 1-channel are 812, as shown in FIG. 2 (*b*) and 2 (*c*). This is realized by executing steps 402–414, as described later.

Namely, the CPU 50 sets high key data of the register portion 61 to "00H" and a high key channel to "FFH" in step 402. Here it should be noted that the key code of the musical tone C2 having the lowest pitch in the keyboard portions 11–14 is "24H". Therefore, the key code indicated by the high key data "00H" is so low that there is not corresponding key in the keyboards 11–14, and a high key channel "FFH" is so large that the corresponding channel in practice does not exist.

Next, the CPU 50 sets the searching channel (n) of the register portion 61 to "0" in step 403. Then, in step 408, this value is serially incremented by 1, and by repeatedly executing steps 404–409, a serial searched for a channel area having the musical tone information of the group which is the same as that of the search group data (step 404) and having the largest key code (steps 405–407), among the channel areas 0–13 of the polyphonic 14-channel area 811 in made. Further, in this search, if a channel area having a larger key code is found in step 405, this key code is set as a new high key data in step 406, and further, the corresponding channel number is set as a high key channel in step 407.

In this case, in the transfer mode, as shown in steps 209 and 210 and steps 220 and 221 of the main routine of FIG. 14A, the search group data "01" corresponds to the upper keyboard 11, and thus among the key information from the upper keyboard 11 assigned to the polyphonic 14-channel area 811, a search is made the key information corresponding to the highest pitch.

Further, in the coupled mode, as shown in steps 209 and 211 and steps 220 and 222, the search group data "00" corresponds to the solo keyboard 13, and thus a search is made for the key information from the solo keyboard 13 assigned to the polyphonic 14-channel area 811.

Moreover, in step 410, the CPU 50 determines whether or not the high key data serially updated in step 406 is equal to or larger than "80H". As seen from the leading address shown in FIG. 8 (*b*), this value "80H" indicates the ON-state in which the ON/OFF data is "1" and the key code is "0000000B". (Here, the subscript B indicates that the number is binary.) If less than "80H", in the transfer mode the high key data indicates that all of the polyphonic 14-channel area 811 are in the KEY OFF state, and further, in the coupled mode, indicates that the channel area assigned to the solo keyboard 13 and included in the polyphonic 14-channel area 811 is in the KEY OFF state. In contrast, if equal to and more than "80H", in the transfer mode the high key data indicates that at least one channel area included in the polyphonic 14-channel area 811 is in the KEY ON state (i.e., at least one key on exists), and further, in the coupled mode, indicates that the channel area assigned to the solo keyboard 13 and included in the polyphonic 14-channel area 811 is in the KEY ON state (i.e., the channel corresponding to this channel are is a key on channel).

Next, in step 411, the CPU 50 determines whether the key code assigned to the solo 1-channel area 812 matches the high key code. If a match is found, the same musical tone information is already assigned to the solo 1-channel area 812, and thus the program returns to the main routine. If a match is not made, the ON/OFF data of the solo 1-channel area 812 is cleared in step 412, and the key code and the velocity data are read from the channel area included in the polyphonic 14-channel area 811 indicated by the thus searched for high key channel and are copied to the solo 1-channel area 812. Data which is the same as the search group data is also copied to the solo 1-channel area 812 as group data. Further, the tone number data, the envelope characteristic data and the holding data shown in FIG. 1 are read from the ROM 70, based on the tone color data corresponding to the solo keyboard timbre of the panel switch memory 63, the key code and the velocity data, and are set in the solo 1-channel area 812 in step 413. Note, there is no data indicated by the sustain switch 26 having the solo keyboard timbre, and thus such data is treated as "0".

Moreover, where the coupler switch 24*a* and the transfer switch 25 are in the normal OFF-state in step 401, the CUP 50 determines, in step 415, whether or not the events determined in steps 203 and 218 are KEY ON events. The contents of the determination or decision are exactly the same as those of the determination made in the step 301. If the decision is affirmative, the CPU 50 determines in step 416 whether it is in the OFF-state in which the ON/OFF data of the solo 1-channel area 812 is "0", or is in the ON-state in which the envelope is percussion type and the holding data in "0", and thus the musical tone information can be newly assigned to a channel. If it is not possible to newly assign the information to a channel, the programs returns to the main routine, but if this is possible, the program jumps to step 402 and the solo key information is copied to the solo 1-channel area 812 as in the processing in the coupled mode effected in steps 402–414.

Thereby, in the transfer mode, the key information corresponding to the musical tone having the highest pitch among the operated keys of the upper keyboard 11 is copied to the solo 1-channel 812, and further, the musical tone having the solo keyboard timbre is sounded as shown in FIG. 2 (*c*). Thus, the transferred musical tone having the solo keyboard timbre can be conspicuously sounded. In this case, the high key data in step 402 may be set as "FFH"; the contents of the process in step 405 may be changed to "the key code (n)<the high key data ?", and then the musical tone information corresponding to the musical tone having the lowest pitch may be copied. Further, among the steps 311–318, the "MIN ENV" data in the step 311 may be changed to "00H"; the step 313 may be deleted; the contents of the processing of step 314 may be changed into "the envelope characteristic data (n)>MIN ENV data;", and the information corresponding to the musical tone having the largest envelope characteristic data may be copied.

Furthermore, in the coupled mode, the solo key information is set in the polyphonic 14-channel area 811 prior to other information, and the corresponding musical tone is sounded as shown in FIG. 2 (*b*). Further, the solo key information of the polyphonic 14-channel area 811 is copied to the solo 1-channel area 812, and the corresponding musical tone having the solo keyboard timbre is sounded.

Additionally, in the normal mode, the solo key information is masked and set in the polyphonic 14-channel area 811 prior to other information. Further, as shown in FIG. 2 (*a*), the solo key information in this polyphonic 14-channel area 811 is copied to the solo 1-channel area 812 and then the musical tone having the solo keyboard timbre is sounded.

Accordingly, the assignment of the information to the solo 1-channel area 812 through the polyphonic 14-channel area 811 is performed, and therefore, among all of the channel areas, the polyphonic 14-channel area 811 is most important. Thus, by checking this polyphonic 14-channel area, the contents of the assignment of the information to all of the channels can be checked.

Thereafter, the CPU 50 sets the ON/OFF data of the solo 1-channel area 812 to the ON-state (corresponding to the value "1") in step 414, and the program returns to the main routine.

12.2 KEY OFF EVENT PROCESSING (STEPS 420–427)

Where, it is concluded in step 410 that all channel areas included in the polyphonic 14-channel area 811 are in the KEY OFF state, or that the channel area assigned to the musical tone information from the solo keyboard 13 is in the KEY OFF state, the CPU 50 clears the solo 1-channel area 812 if the ON/OFF data thereof is "1" and this area is in the ON-state (steps 420 and 421). On the other hand, if the ON/OFF data is "0" and this area is in the OFF-state, the program returns to the main routine. Namely, the KEY OFF event can be controlled through the polyphonic 14-channel area 811.

Further, if the KEY OFF event is detected in step 415, the searching channel (n) of the RAM 60 is set to "0" in step 422. Then, in step 426, this value is serially incremented by 1, and by repeatedly executing steps 423–427, a serial search is made for a channel area having the musical tone information of the group which is the same as that of the search group data (indicating the solo group "00" because of the normal mode) (step 423) and in the ON-state in which the ON/OFF data is "1" (step 424), among the channel areas 0–13 of the polyphonic 14-channel area 811 (step 427). The presence of such a channel area means that a plurality of keys of the solo keyboard 13 have been pressed at the same time and then one key turned off, and that there is another channel area corresponding to the solo keyboard portion 13 which is in the KEY ON state.

Therefore, the CPU 50 sets the number of the latter thus searched channel area, which is in the KEY ON state, in a high key channel register of the register portion 61, in step 425. Further, the process of copying the key information from the polyphonic 14-channel area 811 to the solo 1-channel area 812 (steps 412–141) is performed, but if there are no channel areas which are in the KEY ON state, the program returns to the main routine.

Note, the process of assigning the musical tone information to the pedal 1-channel area 813 is almost the same as that of assigning the musical tone information to the solo 1-channel area 812, except in the following points. First, a pedal tone color selecting switch is not provided with the transfer switch 25, and thus in step 401, only the turning-on or turning-off of the coupler switch 24*b* is determined. Further, the search group in steps 404 and 423 is the pedal group indicated by a number "11" (=3), and moreover, the pedal 1-channel area 813 is the object of the processing effected in steps 411–414, 416, 420 and 421.

Furthermore, where the transfer function is also provided at the pedal keyboard 14, the CPU 50 determines the turning-on or turning-off of the coupler switch 24*b* and the transfer switch 25 in the step 401, and an additional step for performing the same processing as effected in step 226 is added to the program, immediately after step 213. Moreover, an additional step for performing the same processing as effected in steps 220, 221 and 222 is added to the program, immediately before the step 225.

Furthermore, the coupling function may be provided at the lower keyboard portion 12. In this case, the search group established in steps 210 and 221 is the lower group indicated by a number "10" (=2).

13. ENVELOPE CHARACTERISTIC DATA SUBTRACTING PROCESSING

Figure 17:
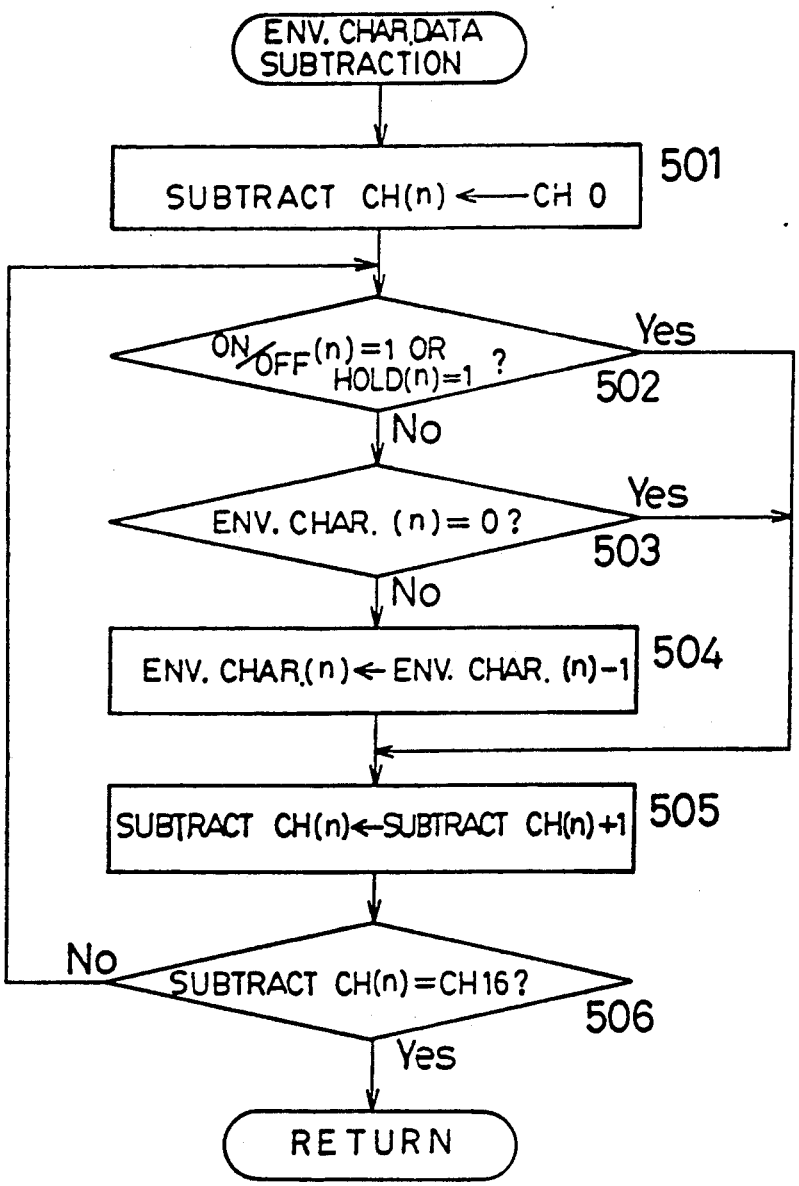

FIG. 17 is a flowchart of the program for effecting the envelope characteristic data subtracting processing. This processing is started by an interrupt signal issued from the timer 40 at constant intervals, as described above.

First, the CPU 50 sets the subtracting channel (n) of the register portion 61 "0" in step 501, and in step 505, this value is serially incremented by 1. Further, by repeatedly executing steps 502–506, a repeated decremented by 1 at one time (step 504) of the envelope characteristic data of a channel area which corresponds to the percussion type envelope having the ON/OFF data "0" (corresponding to the OFF-state) or having the holding data "0" (corresponding to the ON-state) and on which the subtraction of the envelope characteristic data can be performed, the envelope characteristic data of which have not become 0, among the channel areas 0-16, i.e., among all of the channel areas.

By using this envelope characteristic data which is decremented at constant intervals, the envelope is simulated, and the state of the decay of the envelope of each channel can be accurately detected by using only the value of the envelope characteristic data, without a feedback of the envelope data from the envelope generating circuit 806, thereby achieving the most appropriate assignment of the musical tone information to the channels.

Note, in steps 416 and 313, in addition to the step 502, a fresh assignment of the information to a channel is not performed when the holding data is "1" and the envelope is an organ type. Thus, the information on the musical tone corresponding to a key which is turned on before the other simultaneously pressed keys is preferentially assigned to a channel. In contrast, the information on the musical tone corresponding to a key which is turned on after another of the simultaneously pressed keys is not assigned to a channel until the latter key is turned off. This is the channel assignment (hereunder sometimes referred to as earlier pressed key preference assignment), performed by giving preference to an earlier pressed key. As is clear, where this holding data is forcibly made equal to "0" when performing the channel assignment in steps 322 and 413, the channel assignment is newly performed when another key is newly turned on, even if a key pressed earlier than this newly turned on key exists. This is the channel assignment (hereunder sometimes referred to as later pressed key preference assignment) performed by giving preference to a later pressed key.

In this way, the holding data can be used to improve the accuracy of the simulation of the envelope, and further, can be used as a flag for selecting either the earlier pressed key preference assignment or the later pressed key preference assignment of the channel.

14. PROCESS OF COPYING INFORMATION FROM ASSIGNMENT STORING MEMORY 801 TO ASSIGNMENT BUFFER MEMORY 802

Figure 18:
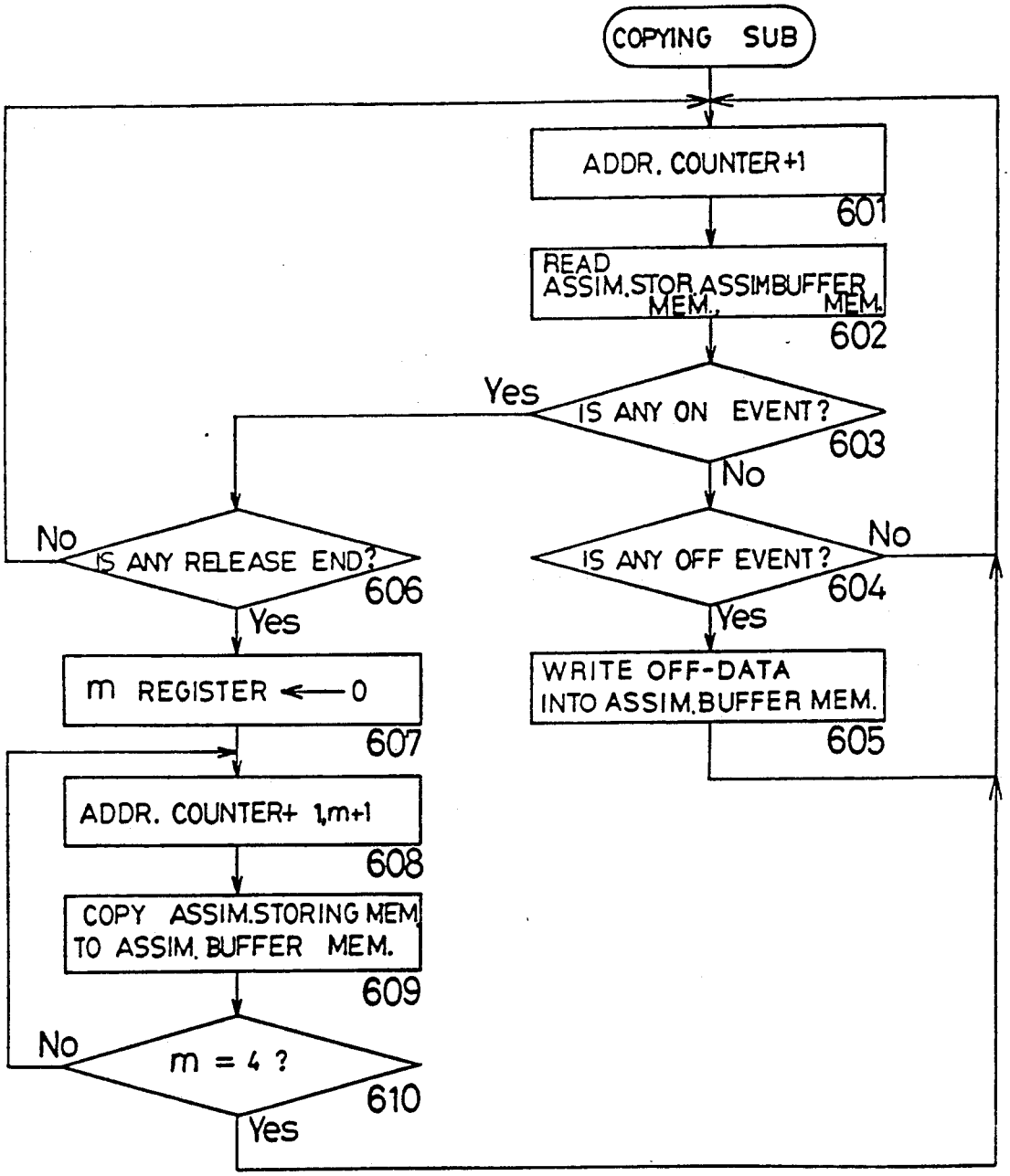

FIG. 18 is a flowchart of a subroutine for performing the process of copying the information from the assignment storing memory 801 to the assignment buffer memory 802. This process is effected by the sub-CPU 821 of the copying operation control circuit 805 in the tone generator 80.

First, the sub-CPU 821 resets the address counter 822, and thereafter, the sub-CUP 821 enables the AND gate AN3 and increases the count indicated by the address counter 822 by using the clock signal 4ϕ in step 601 until an ON-EVENT signal or OFF-EVENT signal is input from the ON/OFF event detecting circuit 803, in steps 603 and 604. This sub-CPU 821 sends the count to the assignment storing memory 801 and the assignment buffer memory 802, and further, makes the write/read command signal for the memories 801 and 802 indicate a read command, in step 602. Then, the sub-CPU 821 constantly serially supplies data representing addresses of channel areas in the assignment storing memory 801 and the assignment buffer memory 802 to the ON/OFF EVENT detecting circuit 803, the envelope generating circuit 806, and the musical tone waveform generating circuit 807.

When receiving the ON-EVENT signal, the sub-CPU 821 once disables the AND gate AN3 and then changes the state of only the write/read command signal for the assignment buffer memory 802 into a state of indicating the write command, in step 605, without changing the address data, and further, writes ON/OFF data from the assignment storing memory 801 indicating the OFF-state (corresponding to "0") to the assignment buffer memory 802. This processing of steps 604 and 605 is effected when the functions of a key off writing circuit 804 are included in the copying operation control circuit 805, but is not performed when the key off writing circuit 804 is separate from the circuit 805.

When the ON-EVENT signal is input, the sub-CPU 821 determines whether the release end signal has been output thereto from the envelope generating circuit 806, in step 606. If the release end signal is not input, the sub-CPU 821 repeatedly performs the processing of steps 606, 601, 602 and 603 until the release end signal is input thereto. When the release end signal is input to the sub-CPU, the sub-CPU 821 resets them-register 825 of the sub-RAM 824 to "0" in step 607, and increments the address counter 822 and the m-register 825 by 1, in step 608, until the value indicated by the m-register reaches "4" in step 610. Further, the sub-CPU 821 changes the state of only the write/read command signal for the assignment buffer memory 802 into the state indicating the write command, in step 609, and performs the process of copying the information relating to the channel area to which the ON-EVENT signal and the release end signal are input, from the assignment storing memory 801 to the assignment buffer memory 802.

As described above, the tasks of performing the process of copying the information to the assignment buffer memory 802 are formed into a queue while the processing of steps 606, 601 602 and 603 is repeated until release end signal is input to the sub-CPU. Thereby, as shown in the lower portion of FIG. 3, the next musical tone information can be immediately assigned to the assignment storing memory 801, without a standby. In contrast, the next musical tone information is not assigned to the assignment buffer memory 802, until the termination of the high-speed release, thereby preventing a change of the pitch and timbre during the high-speed release.

While a preferred embodiment of the present invention has been described above, it is understood that the present invention is nott limited thereto and that other modifications will be apparent to those skilled in the art without departing from the spirit of the invention. For example, the tone color coefficients such as the envelope characteristic data shown in FIG. 1 may be established for every kind of musical effect effecting the envelope, except the sustain effect, at every established tempo, at every established rhythm, and at every established volume. Futher, each of the tone color information assigned to the solo 1-channel area 812 from the upper keyboard 11 in the transfer and normal modes and the tone color information assigned to the polyphonic 14-channel area 811 from the solo keyboard 11 and the pedal keyboard 14 may include the key information and may occupy channel areas other than channel areas corresponding to other keyboards, completely independently from the other keyboards. The content of the information assigned to the solo 1-channel area 812 and the pedal 1-channel area 813 may be that copied from the register portion 61 instead of that copied the polyphonic 14-channel area 811. The musical tone information may be copied from the assigment storing memory 801 to the assignment buffer memory 802 by the CPU 50, instead of the copying operation control circuit 805 and the key off writing circuit 804, and instructions for the sounding of the musical tones may be output by an external MIDI musical instrument or by a device other than the keyboard. The sounded musical tone corresponding to a key may be made from a plurality of musical tone waveforms and envelopes. In this case, diffferent tone number, envelope characteristic data, and holding may be simultaneously assigned to a plurality of channels by a KEY ON EVENT.

The scope of the present invention, therefore, is determined solely by the appended claims.

I claim:

1. An electronic musical instrument comprising:

musical tone selecting means for selecting a plurality of musical tones having different envelopes;

a plurality of sound radiation instructing means for radiating sound for the plurality of musical tones;

channel assigning means for assigning channels to the plurality of musical tones selected by said musical tone selecting means; and envelope waveform generating means for generating envelope waveforms corrseponding to the plurality of musical tones to which channels are assigned by said channel assigning means; said channel assigning means including, characteristic information generating means for generating characteristic information corresponding to characteristics of the envelope waveforms corresponding to the plurality of musical tones to be radiated, by said radiation instructing means, change processing means for changing the characteristic information generated by said characteristic information generating means as a function of time, and assigned channel determining means for comparing results of the processing performed by said change processing means and determining a channel to which one of the plurality of musical tones is to be assigned in respones to a start sound radiation insutruction received from said sound radiation instructing means.

2. The electronic musical instrument of claim 1, wherein said musical tone selecting means selects the plurality of musical tones having different envelopes, based on tone color, and said characteristic information generating means generates tone color characteristic information corresponding to characteristics of the envelope waveforms.

3. The electronic musical instrument of claim 1, wherein said musical tone selecting means selects the plurality of musical tones having different envelopes, based on musical effects, and said characteristic information generating means generates musical effect characteristic information corresponding to characteristics of the envelope waveforms.

4. The electronic musical instrument of claim 1, wherein said musical tone selecting means selects the plurality of musical tones having different envelopes, based on pitch, and said characteristic information generating means generates pitch characteristic information corresponding to characteristics of the envelope waveforms.

5. The electronic musical instrument of claim 1, wherein said musical tone selecting means selects the plurality of musical tones having different envelopes based on a strength and speed of an operation for radiating a musical tone, and said characteristic information generating means generate characteristic information based on the strength and speed of the operation for radiating, corresponding to characteristics of the envelope waveforms.

6. The electronic musical instrument of claim 1, wherein the envelopes of the plurality of musical tones selected by said muscial tone selecting means decay while said sound radiation instructing means is radiating sound for the plurality of musical tones.

7. The electronic musical instrument of claim 1, wherein the envelopes of the plurality of musical tones selected by said musical tone selecting means decay after said sound radiation instructing means has completed radiating sound for the plurality of musical tones.

8. The electronic musical instrument of claim 6, wherein said change processing means commences processing after said sound radiation instructing means has begun radiating sound for the plurality of musical tones.

9. The electronic musical instrument of claim 7, wherein said change processing means commences processing after said sound radiation instructing means has completed radiating sound for the plurality of musical tones.

10. The electronic musical instrument of claim 8, wherein said assigned channel determining means assigns the characteristic information corresponding to the plurality of musical tones to a channel corresponding to each musical tone, after said sound radiation instructing means radiates sound for each of the plurality of musical tones.

11. The electronic musical instrument of claim 9, wherein said assigned channel determining means assigns the characteristic information corresponding to the plurality of musical tones to a channel corresponding to each musical tone, after said sound radiation instructing means radiates sound for each of the plurality of musical tones.

12. A channel assigning device for use in an electronic musical instrument, comprising:

a plurality of sound radiation instructing means for issuing instructions for radiating sound for a plurality of musical tones, said sound radiating instructing means being divided into a plurality of instructing-means groups;

scanning means for scanning the plurality of sound instructing-means groups of each of said sound radiating instructing means and, in order to determine the presence of an instruction, for radiating sound for one of the plurality of musical tones issued by one said plurality of sounds radiation instructing means;

a plurality of channels which are divided into a plurality of channel groups, each of said channel groups respectively corresponding to one of said instructing-means groups; and assignment control means including, a plurality of first channel means, one provided for each instructing-means group, for assigning a channel to one of the plurality of musical tones for which an instruction for radiating sound has been issued by the one of said plurality of sound radiation instructing means correponding to the channel group of the channel to be assigned, based on the determinations of said scanning means, and a plurality of second channel assigning means for overlappingly assigning the channel, which has be assigned to one of the plurality of musical for which the instruction for radiating sound has been issued by the one of said plurality sound radiation instructing means corresponding to the channel group of the channel to be assigned, to another of the plurality of musical tones for which an instruction for radiating sound has been issued by another of said plurality of sound radiation instructing means which does not correspond to the channel group of the channel to be assigned.

13. The channel assigning device of claim 12, wherein said assignment control means makes said one of said plurality of channels originally corresponding to the one of the plurality of musical tones, the channel assignment of which is controlled by said assignment control means, assign the musical tone information the channel assignment if which is controlled by said assignment control means, to a channel.

14. The channel assigning device of claim 13, wherein said assignment control means copies musical tone information for both tones from said plurality of sound radiation instructing means which do not correspond thereto, the channel assignment of which is controlled by said assignment control means, said sound radiation instructing means originally corresponding thereto.

15. The channel assigning device of claim 13 wherein said assignment control means controls the assignment of the musical tones from the one of said plurality of sound radiation ir structing means not originally corresponding thereto, to one of the plurality of channels from which the use of the plurality of musical tones is not radiated.

16. The channel assigning device as set forth in claim 12, 13, 14 or 15 wherein said assignment control means assigns a musical tone from a monophonic one of said plurality of channels to a polyphonic one of said plurality of channels.

17. The channel assigning device of claim 16, wherein when said assignment control means assigns the musical tone from the monophonic one of said plurality of channels to the polyphonic one of said plurality of channels, said polyphonic one of said plurality of channels assigning musical tone information of the musical tone from the monophonic one of said plurality of channels with the highest pitch, to the polyphonic channel.

18. The channel assigning device of claim 12, wherein the musical tones to which the channel is overlappingly assigned have different timbres.

19. The channel assigning device of claim 12, wherein the misical tone to which the channels is overlappingly assigned have different envelope waveforms.

20. A channel assigning device for use in an eletronic musical instrument, comprising:

sound radiation instructing means for issuing instructions for radiating sound for a plurality of musical tones;

first channel assigning means for assigning one of the plurality of musical tones issued instructions by said sound radiation instructing means to a first channel;

second channel assigning means for assigning the one of the plurality of musical tones issued instructions by said sound radiation instructing means to a second channel;

copying means for copying musical tone information corresponding to another of the plurality of musical tone from said first channel assigning means, said second channel assigning means generating and issuing instruction for radiating sound for the other of the plurality of muscial tones on a plurality of channels in accordance with the musical tone information copied by said copying means;

assignment control means for making said first channel assigning means immediately assign the muscial tone information on the one of said pluriality of musical tones to a channel in response to new issuing instruction for radiating sound for the other of the plurality of tones musical from said sound radiation instructing means, while the one of the plurality of musical tones corresponding to the channel is being radiated; and copying operation standing-by means for delaying said copying means until radiating sound of the one of the plurality of musical tones is terminated when the other of the plurality musical tones corresponding to the assigned musical tone information is being radiated.

* * * * *